US009135773B2

(12) United States Patent
Graves et al.

(10) Patent No.: US 9,135,773 B2
(45) Date of Patent: Sep. 15, 2015

(54) BINGO APPARATUS

(76) Inventors: Gordon T. Graves, Austin, TX (US); Martin A. Keane, Chicago, IL (US)

( * ) Notice: Subject to any disclaimer, the term of this patent is extended or adjusted under 35 U.S.C. 154(b) by 203 days.

(21) Appl. No.: 13/507,344

(22) Filed: Jun. 21, 2012

(65) Prior Publication Data

US 2012/0270631 A1 Oct. 25, 2012

Related U.S. Application Data

(63) Continuation-in-part of application No. 13/066,371, filed on Apr. 13, 2011.

(60) Provisional application No. 61/342,346, filed on Apr. 13, 2010, provisional application No. 61/400,513, filed on Jul. 29, 2010, provisional application No. 61/401,028, filed on Aug. 6, 2010, provisional application No. 61/462,986, filed on Feb. 10, 2011.

(51) Int. Cl.
*A63F 9/24* (2006.01)
*G07F 17/32* (2006.01)

(52) U.S. Cl.
CPC ..... *G07F 17/32* (2013.01); *G07F 17/3225* (2013.01); *G07F 17/3244* (2013.01); *G07F 17/329* (2013.01); *G07F 17/3293* (2013.01)

(58) Field of Classification Search
USPC ..... 463/19, 16
IPC ..... G07F 17/32
See application file for complete search history.

(56) References Cited

U.S. PATENT DOCUMENTS 6,159,095 A * 12/2000 Frohm et al. ..... 463/19

* cited by examiner

*Primary Examiner* — Omar Deodhar
(74) *Attorney, Agent, or Firm* — Michael B. McMurry

(57) ABSTRACT

Described is a method of constructing prize structures that are particularly useful in gaming systems which can be used to implement various games such as bingo and poker. In particular the described pay structures and game systems can have sufficient granularity such that the outcome or payoff of the game being played can be expanded to provide higher payout amounts as well as closely replicate the payoff of a second game. Included are methods and apparatus for playing bingo games and determining which bingo cards are winners. In addition, methods and apparatus for evaluating or checking each card in a bingo game using a bit marked card technique and vector operations are described.

6 Claims, 12 Drawing Sheets

Fig. 1
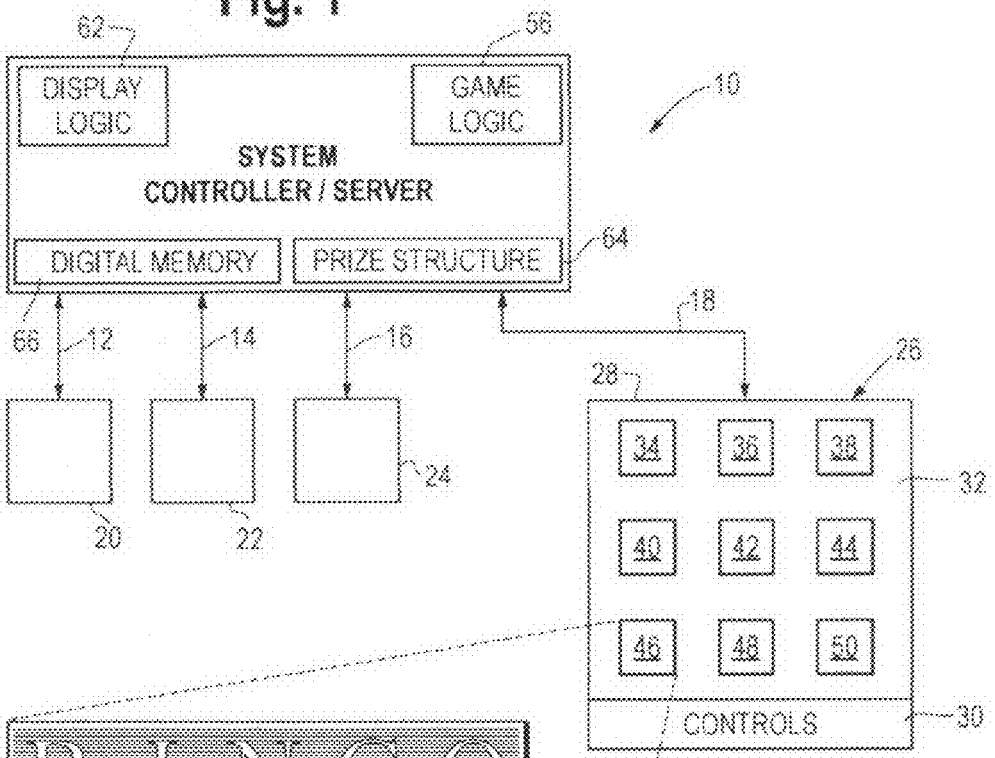
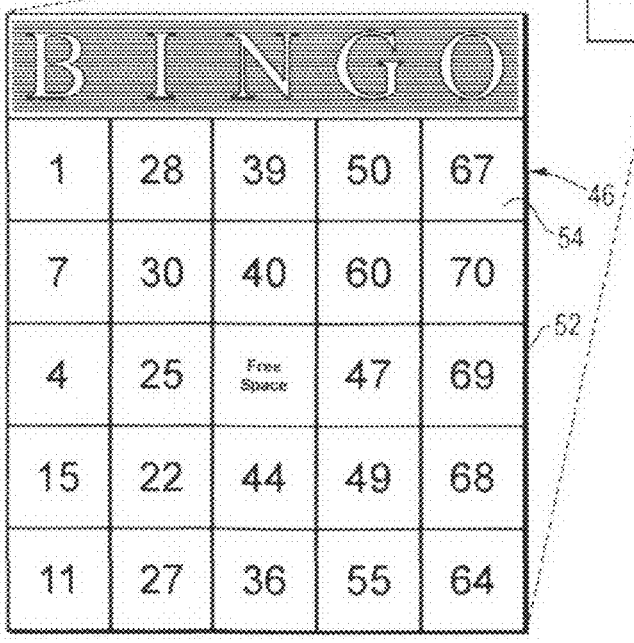
Fig. 2
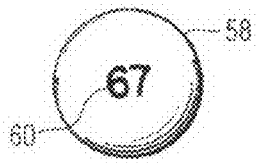

Fig. 5

| BEST HAND | BEST HAND PAYS | PROBABILITY | RETURN |
|---|---|---|---|
| ROYAL FLUSH | 100000 | 0.0000308 | 3.08 |
| STRAIGHT FLUSH | 10000 | 0.0002772 | 2.77 |
| FOUR OF A KIND | 1000 | 0.0047932 | 4.79 |
| FULL HOUSE | 100 | 0.0283039 | 2.83 |
| FLUSH | 25 | 0.0231172 | 0.58 |
| STRAIGHT | 10 | 0.0716117 | 0.72 |
| THREE OF A KIND | 6 | 0.3049344 | 1.83 |
| TWO PAIR | 4 | 0.3591301 | 1.44 |
| ON PAIR JQKA | 2 | 0.1978015 | 0.40 |
| ONE PAIR < JACKS | 100 | 0.0099989 | 1.00 |
| HIGH CARD | 1000 | 0.0000010 | 0.00 |
| **TOTAL** | | 1.0000000 | 19.43 |

TABLE 1. PRIZE STRUCTURE FOR 20 PLAYER MULTI-DECK WINNER-TAKE-ALL SHOWDOWN POKER GAME

Fig. 7

| BEST HAND | BEST HAND PAYS | PROBABILITY | RETURN |
|---|---|---|---|
| ROYAL FLUSH | 8000 | 0.0004951 | 3.96 |
| STRAIGHT FLUSH | 1000 | 0.0021767 | 2.18 |
| FOUR OF A KIND | 75 | 0.0460965 | 3.46 |
| FULL HOUSE | 25 | 0.1970758 | 4.93 |
| FLUSH | 12 | 0.1517619 | 1.82 |
| STRAIGHT | 8 | 0.1245755 | 1.00 |
| THREE OF A KIND | 6 | 0.3821104 | 2.29 |
| TWO PAIR | 4 | 0.0915729 | 0.37 |
| LESS THAN TWO PAIR | 0 | 0.0041297 | - |
| **TOTAL** | | 1.0000 | 20.00 |

TABLE 2. PRIZE STRUCTURE FOR 20 PLAYER MULTI-DECK WINNER-TAKE-ALL DRAW POKER GAME

Fig. 8

| HAND | SINGLE PLAYER PROBABILITY | BEST HAND PROBABILITY | BEST HAND PAYOUT | ALL HANDS PAYOUT | RETURN |
|---|---|---|---|---|---|
| ROYAL FLUSH | 0.00002 | 0.00050 | 8000 | | 3.96 |
| STRAIGHT FLUSH | 0.00011 | 0.00218 | 1000 | | 2.18 |
| FOUR OF A KIND | 0.00236 | 0.04610 | 75 | | 3.46 |
| FULL HOUSE | 0.01151 | 0.19708 | 25 | | 4.93 |
| FLUSH | 0.01102 | 0.15176 | 10 | | 1.52 |
| STRAIGHT | 0.01123 | 0.12458 | | 4 | 0.90 |
| THREE OF A KIND | 0.07445 | 0.38211 | | 2 | 2.98 |
| **TOTAL** | | 1 | | | 19.92 |

TABLE 3. MIXED (HYBRID) PRIZE STRUCTURE FOR 20 PLAYER MULTI-DECK DRAW POKER GAME

Fig. 9

| BEST HAND | SECOND BEST HAND | BEST HAND PROB | SECOND BEST HAND PROB | JOINT PROB PARTS PER MILLION | BEST HAND PAYOUT | SECOND BEST HAND PAYOUT | TOTAL RETURN TO PLAYERS |
|---|---|---|---|---|---|---|---|
| ROYAL FLUSH | RF OR SF | 0.000495 | 0.00254 | 1.3 | 100000 | 5000 | 0.13 |
| ROYAL FLUSH | 4 KIND | 0.000495 | 0.04385 | 21.7 | 20000 | 500 | 0.45 |
| ROYAL FLUSH | * | 0.000495 | 0.95361 | 472.3 | 8000 | | 3.78 |
| STRAIGHT FLUSH | SF | 0.002177 | 0.00207 | 4.5 | 10000 | 500 | 0.05 |
| STRAIGHT FLUSH | 4 KIND | 0.002177 | 0.04385 | 95.4 | 5000 | 50 | 0.48 |
| STRAIGHT FLUSH | * | 0.002177 | 0.95361 | 2,075.7 | 1000 | | 2.08 |
| FOUR OF A KIND | | 0.046097 | 0.04385 | | 75 | | 3.46 |
| FULL HOUSE | | 0.197076 | 0.18874 | | 20 | | 3.94 |
| FLUSH | | 0.151762 | 0.14702 | | 12 | | 1.82 |
| STRAIGHT | | 0.124576 | 0.12206 | | 8 | | 1.00 |
| THREE OF A KIND | | 0.382110 | 0.38817 | | 6 | | 2.29 |
| TWO PAIR | | 0.091573 | 0.10218 | | 4 | | 0.37 |
| **TOTAL** | * = ANY OTHER HAND | | | | | | 19.84 |

TABLE 4. PRIZE STRUCTURE FOR MULTI-DECK 20 PLAYER WINNER-TAKE-ALL DRAW POKER GAME WITH PRIZE AMOUNTS DETERMINED BY MULTIPLE HAND'S SCORES AND "BAD BEAT" CONSOLATION PRIZE TO SECOND BEST HAND

Fig. 12A

| MAJOR HAND CLASS NAME | NUMBER OF RANKS IN MAJOR HAND CLASS | LOWEST RANKED HAND | HIGHEST RANKED HAND | LOWEST RANK | HIGHEST RANK | HAND COUNT PER RANK | NUMBER HANDS |
|---|---|---|---|---|---|---|---|
| STRAIGHT FLUSH | 40 | 5 4 3 2 A d | A K Q J T s | 7483 | 7522 | 1 | 40 |
| FOUR OF A KIND | 156 | 2 2 2 2 3 | A A A A K | 7327 | 7482 | 4 | 624 |
| FULL HOUSE | 156 | 2 2 2 3 3 | A A A K K | 7171 | 7326 | 24 | 3744 |
| ACE HIGH FLUSH | 493 | A 6 4 3 2 | A K Q J 9 | 6678 | 7170 | 4 | 1972 |
| KING HIGH FLUSH | 329 | K 5 4 3 2 | K Q J T 8 | 6349 | 6677 | 4 | 1316 |
| QUEEN HIGH FLUSH | 209 | Q 5 4 3 2 | Q J T 9 7 | 6140 | 6348 | 4 | 836 |
| JACK HIGH FLUSH | 125 | J 5 4 3 2 | J T 9 8 6 | 6015 | 6139 | 4 | 500 |
| 10 HIGH FLUSH | 69 | T 6 4 3 2 | T 9 8 7 5 | 5946 | 6014 | 4 | 276 |
| 9 HIGH FLUSH | 34 | 9 5 4 3 2 | 9 8 7 6 4 | 5912 | 5945 | 4 | 136 |
| 8 HIGH FLUSH | 14 | 8 5 4 3 2 | 8 7 6 5 3 | 5898 | 5911 | 4 | 56 |
| 7 HIGH FLUSH | 4 | 7 5 4 3 2 | 7 6 5 4 2 | 5894 | 5897 | 4 | 16 |
| ACE HIGH STRAIGHT | 4 | Ad K Q J T | As K Q J T | 5890 | 5893 | 255 | 1020 |
| KING HIGH STRAIGHT | 4 | Kd Q J T 9 | Ks Q J T 9 | 5886 | 5889 | 255 | 1020 |
| QUEEN HIGH STRAIGHT | 4 | Qd J T 9 8 | Qs J T 9 8 | 5882 | 5885 | 255 | 1020 |
| JACK HIGH STRAIGHT | 4 | Jd T 9 8 7 | Js T 9 8 7 | 5878 | 5881 | 255 | 1020 |
| 10 HIGH STRAIGHT | 4 | Td 9 8 7 6 | Ts 9 8 7 6 | 5874 | 5877 | 255 | 1020 |
| 9 HIGH STRAIGHT | 4 | 9d 8 7 6 5 | 9s 8 7 6 5 | 5870 | 5873 | 255 | 1020 |
| 8 HIGH STRAIGHT | 4 | 8d 7 6 5 4 | 8s 7 6 5 4 | 5866 | 5869 | 255 | 1020 |
| 7 HIGH STRAIGHT | 4 | 7d 6 5 4 3 | 7s 6 5 4 3 | 5862 | 5865 | 255 | 1020 |
| 6 HIGH STRAIGHT | 4 | 6d 5 4 3 2 | 6s 5 4 3 2 | 5858 | 5861 | 255 | 1020 |
| 5 HIGH STRAIGHT | 4 | 5d 4 3 2 A | 5s 4 3 2 A | 5854 | 5857 | 255 | 1020 |

Fig. 12B

| MAJOR HAND CLASS NAME | NUMBER OF RANKS IN MAJOR HAND CLASS | LOWEST RANKED HAND | HIGHEST RANKED HAND | LOWEST RANK | HIGHEST RANK | HAND COUNT PER RANK | NUMBER HANDS |
|---|---|---|---|---|---|---|---|
| THREE OF A KIND | 858 | 2 2 2 4 3 | A A A K Q | 4996 | 5853 | 64 | 54912 |
| TWO PAIR | 858 | 3 3 2 2 4 | A A K K Q | 4138 | 4995 | 144 | 123552 |
| ONE PAIR | 2860 | 2 2 5 4 3 | A A K Q J | 1278 | 4137 | 384 | 1098240 |
| ACE-HIGH | 493 | A 6 4 3 2 | A K Q J 9 | 785 | 1277 | 1020 | 502860 |
| KING HIGH | 329 | K 5 4 3 2 | K Q J T 8 | 456 | 784 | 1020 | 335580 |
| QUEEN HIGH | 209 | Q 5 4 3 2 | Q J T 9 7 | 247 | 455 | 1020 | 213180 |
| JACK HIGH | 125 | J 5 4 3 2 | J T 9 8 6 | 122 | 246 | 1020 | 127500 |
| 10 HIGH | 69 | T 5 4 3 2 | T 9 8 7 5 | 53 | 121 | 1020 | 70380 |
| 9 HIGH | 34 | 9 5 4 3 2 | 9 8 7 6 4 | 19 | 52 | 1020 | 34680 |
| 8 HIGH | 14 | 8 5 4 3 2 | 8 7 6 5 3 | 5 | 18 | 1020 | 14280 |
| 7 HIGH | 4 | 7 5 4 3 2 | 7 6 5 4 2 | 1 | 4 | 1020 | 4080 |
| TABLE 3. RANKING OF POKER HANDS | | | | | | | 2598960 |

Fig. 13

| BEST HAND | SECOND BEST HAND | BEST HAND PROB | SECOND BEST HAND PROB | JOINT PROB PARTS PER MILLION | BEST HAND PAYOUT | RETURN TO PLAYERS | RETURN AS A % OF COIN IN |
|---|---|---|---|---|---|---|---|
| ROYAL FLUSH | ** | 0.000009 | 0.03164 | 0.292136 | 1,000,000 | 0.2921 | 4.87% |
| ROYAL FLUSH | * | 0.000009 | 0.96836 | 8.942292 | 50,000 | 0.4471 | 7.45% |
| STRAIGHT FLUSH | | 0.000083 | 1.00000 | 83.1 | 10,000 | 0.8311 | 13.85% |
| FOUR OF A KIND | | 0.001440 | 1.00000 | 1,440 | 100 | 0.1440 | 2.40% |
| FULL HOUSE | | 0.008601 | 1.00000 | 8,601 | 50 | 0.4301 | 7.17% |
| FLUSH | | 0.011635 | 1.00000 | 11,365 | 25 | 0.2909 | 4.85% |
| STRAIGHT | | 0.022893 | 1.00000 | 22,893 | 15 | 0.3434 | 5.72% |
| THREE OF A KIND | | 0.115721 | 1.00000 | 115,721 | 8 | 0.9258 | 15.43% |
| TWO PAIR | | 0.218295 | 1.00000 | 218,295 | 4 | 0.8732 | 14.55% |
| PAIR >= JACKS | | 0.371275 | 1.00000 | 371,275 | 3 | 1.1138 | 18.56% |
| PAIR < JACKS | | 0.234200 | 1.00000 | 234,200 | | | |
| HIGH CARD | | 0.015847 | 1.00000 | 15,847 | | | |
| **TOTAL** | | | | 1,000,000 | | | 94.86% |

TABLE 1. PRIZE STRUCTURE FOR MULTI-DECK 6 PLAYER SHOWDOWN POKER GAME WITH PRIZE AMOUNTS DETERMINED BY MULTIPLE HANDS'S SCORES

* = BETTER THAN 7 HIGH STRAIGHT, ** 7 HIGH STRAIGHT OR LESS

BINGO APPARATUS

CROSS-REFERENCE TO RELATED APPLICATIONS

This patent application is a Continuation-In-Part application of Ser. No. 13/066,371, filed Apr. 13, 2011 and claims priority on provisional patent application Ser. Nos. 61/342,346, filed Apr. 13, 2010; Ser. No. 61/400,513, filed Jul. 29, 2010; Ser. No. 61/401,028, filed Aug. 6, 2010; and Ser. No. 61/462,986, filed Feb. 10, 2010.

FIELD OF THE DESCRIBED APPARATUS

The described mechanisms and methods relate generally to electronic gaming apparatus and gaming methods including bingo and methods for constructing prize structures as well as bingo determination methods.

BACKGROUND

In the gaming industry in general and in casino environments as well as internet applications in particular it is desirable to provide gaming systems including bingo apparatus and systems that are attractive for customers to play while providing an acceptable return to the proprietor of the gaming systems. It is also desirable to provide multiplayer card gaming systems that are attractive for customers to play while providing an acceptable return to the proprietor of the gaming systems.

Regarding bingo games, most electronic bingo games are played in a similar manner to conventional bingo games where a player pays for and plays one or more bingo cards. Balls having marks or symbols corresponding to squares on the cards are sequentially drawn, or in the case of electronic systems, randomly generated. The first card in which a predetermined patterns of squares, such as columns, diagonals, rows or corners, is filled by symbols on the drawn balls is the winner. Typically, the prize is paid to the player with the winning card or if two or more cards have one of the predetermined patterns, the prize can be split. There are a number of variations on this approach especially in electronic implementations of bingo. For example, after the initial purchase of one or more cards, the game requires the players to pay a predetermined amount per card for the next ball or series of balls and thus the player has the option of only paying for cards that appear to be close to winning.

However, the bingo games as described above have a number of disadvantages. For example, since the games normally pay out only one large prize to the player having a winning pattern, a player playing a bingo game, especially with a large number of players, can play for a long time without winning anything and hence become discouraged.

Also, a number of problems can arise in implementing the bingo games as described above in an electronic format, or especially in internet based games. For example, since an internet based bingo game can have thousands of players playing a game where in addition each player can have a number of cards, the marking and evaluating each of what can be thousands of cards for a winning bingo pattern after each ball is drawn in a rapid and efficient manner can be a challenge.

Regarding multiplayer poker gaming systems, one approach to such a system involves each player playing on his own terminal or personal computer where under control of a central computer or internet website the players play against each other. The terminals can have displays showing the hands as dealt, winning hands and other game information. The game can be played using the central computer to deal each player a hand from one or more simulated card decks corresponding to casino type games where a dealer deals hands from one or more card decks. However, this approach tends to be effectively limited to about ten players (10 players×5 cards per player=50 cards from a 52 card deck). For such a system with more than ten players, it becomes difficult to construct a prize structure when dealing is done from a single deck or even a combination of multiple decks and especially for internet games which might have thousands of players in a single game. As a result, poker type games with very high payouts based, for example, on the number of players in the game become especially difficult to construct.

One example of an attempt to provide enhanced player appeal is to structure a multiplayer gaming system such that each individual gaming machine includes a set of player controls in which a game such as bingo, keno or poker can be played and a first display for displaying the game as it is played and further includes a second display for displaying the outcome of the game in a different game format. The second display can for example display the outcome and indicate the payout of a bingo game in the form of spinning slot machine reels. Examples of these types of gaming systems are shown in U.S. Pat. Nos. 7,322,886 and 7,641,552.

However, the dual game display approach as described above does not address the problem of providing prize structures, especially where one type of game is played and the outcome is displayed in a different game format, such that the prize structures are sufficiently flexible to allow game designers to optimize payoff tables for maximum player appeal while providing a specified return to the game system proprietor.

SUMMARY

Described is a method of constructing a bingo prize structure which is particularly useful in a bingo gaming system, in which prizes can be awarded for cards that have a predetermined number or configuration of squares filled but are less than required for a bingo. One advantage of this approach is that pay structures can be constructed for a bingo game that closely replicate other gaming systems, for example, the payoff structure of a spinning reel slot machine.

Also described is a method of constructing an apparatus and method for marking and evaluating or checking each card in a bingo game using a bit marked card technique and vector operations.

Regarding multiplayer card game systems, described is a method of constructing a competitive multiplayer card game, that uses a simulated single deck of cards associated with each player or terminal, where the central game controller deals a player's hand from the deck associated with that player's terminal. Also described are examples of prize structures for use with such multiplayer poker games that provide enhanced prizes to the winning players as well as providing a return to the proprietor of the gaming system.

With respect to dual game displays as well as other gaming systems, a method of constructing prize structures, that are particularly useful in gaming systems having dual game displays, and in particular pay structures that have sufficient granularity such that the outcome or payoff of the game being played, such as poker can closely replicate, for example, the payoff of a spinning reel slot machine and displayed as such.

Also described is an example of a multiplayer video poker game where the results and payoffs for each player can be displayed on a video replica of a spinning wheel slot machine which in turn can use a prize structure constructed with the described method.

BRIEF DESCRIPTION OF THE DRAWINGS

FIG. 1 is a block diagram of a multiplayer bingo gaming system suitable for utilizing the described prize structure; marking all the active cards in game in response to balls being drawn; and determining winning bingo cards during a game;

FIG. 2 is a representation of a simulated bingo ball for use with the system of FIG. 1;

FIG. 5 is a tabular illustration of a prize structure that can be used with the winner take all showdown poker game of FIG. 4 having 20 players;

FIG. 7 is a tabular illustration of a prize structure that can be used with the draw poker game of FIG. 6 having 20 players;

FIG. 8 is a tabular illustration of a hybrid prize structure that can be used with the draw poker game of FIG. 6 having 20 players;

FIG. 9 is a tabular illustration of a prize structure where the prize amounts are determined by the scores of multiple hands that can be used with the draw poker game of FIG. 6 having 20 players;

FIG. 12 is a table showing how the granularity of a game of five card poker can be increased for use with a spinning reel slot machine display of the arrangement shown in FIG. 11; and FIG. 13 is a table showing how the granularity of a game of card showdown poker can be increased using scores for multiple hands for use with a spinning reel slot machine display of the arrangement shown in FIG. 11.

DETAILED DESCRIPTION

Figure 3:
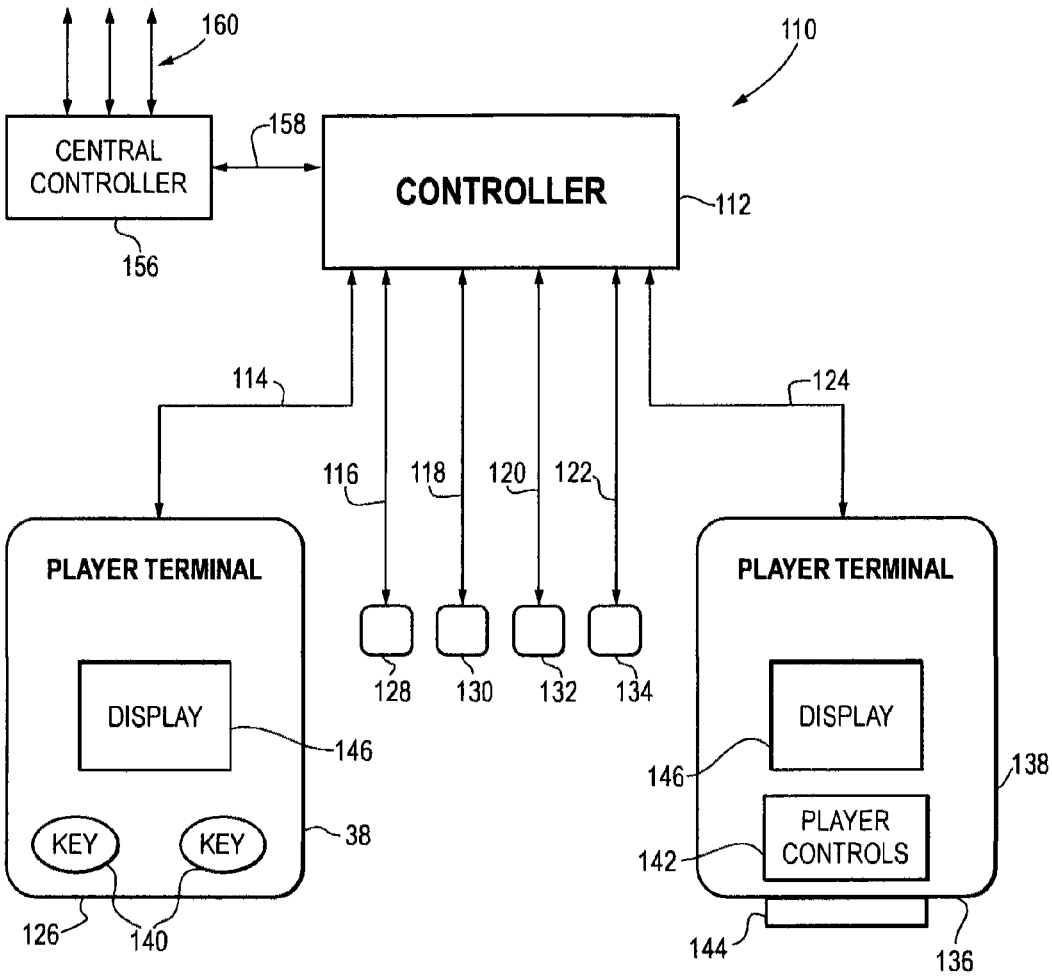
FIG. 3 is a block diagram of a multiplayer gaming system suitable for utilizing the described gaming system.

FIG. 1 is a block diagram of a multiplayer bingo gaming system that provides a representative example of an environment in which the below described bingo prize structure can be implemented. In this example, a central system controller or server 10 is used to control the system. In a casino environment the controller 10 can be a central gaming system computer and in an Internet application the controller 10 can be a system server. Connected to the central controller 10, as represented by a set of communication lines 12-18, are, in this embodiment, a group of player operated terminals represented by a set of blocks 20-26. The player operated terminals 20-26 can be configured in various ways including conventional casino type video bingo gaming machines. Alternatively, the player terminals 20-26 as shown can represent Internet appliances such as personal or tablet computers connected over the Internet as represented by the lines 12-18 to the server 10. As with existing internet bingo games, there can be literally thousands of player terminals 20-26 connected to the server 10 for any one bingo game. The terminal 26 is depicted in FIG. 1 in expanded form to illustrate various features of this machine 26 including a housing 28 and a set of player controls 30. Also, included in the machines 20-26 are a video display 32 that, in this example, displays a set of nine bingo cards 34-50 for a particular bingo game. The card 46 is expanded in FIG. 1 to show a typical bingo card. As with most conventional bingo cards, the card 46 includes a 5×5 matrix 52 of squares where each square contains a number or play symbol such as number 67 in the upper right hand corner 54 of the matrix 52.

In operation, the system controller or server 10 includes a game logic program 56 that among other functions can transmit electronic versions of the bingo cards 34-50 to the player terminals 20-26 for display on the displays 32 and randomly generate or "draw" a sequence of simulated bingo balls such as a ball 58 depicted in FIG. 2, each having a unique number or symbol such as a number 67 shown at 60 of FIG. 2. In this embodiment, the system controller also includes a card display logic program represented at 62 that serves to generate displays of the cards 34-50 on the terminal displays 32 along with a prize structure program 64 that can be used to award prizes to winners of a game. Also, as is typical of bingo games, the game logic 62 in this example can award prizes based on a set of predetermined patterns on the cards 20-26 such as drawn numbers filling in one column, one row, a diagonal or four corners of the matrix 52. In addition the game logic 56 in combination with a digital memory 66 can be programmed to use a bit map structure and vector operations as described below to determine if one or more of the bingo cards displayed on the terminals 20-28 contains one of the predetermined winning patterns after each draw.

It should be understood that the system shown in FIG. 1 is just a representative example of a gaming system that can make use of the methods described below. Also, an internet arrangement can be used implement such a system where, as indicated above, personal computers can serve as the player operated machines 20-26 and the lines 12-18 represent internet connections with a control system resident on a server that functions as the system computer 10. Additionally, the various functions such as the game logic 56, display logic 62 and prize structure logic 64 can be allocated between elements including the system controller 10 and the terminals 20-26 as well as other hardware elements depending on the hardware and software used to implement the video bingo game.

Tables 1-3 below illustrate a prize structure that can be used with bingo gaming systems of the type described above. Generally in this structure, a prize in addition to the bingo prize is awarded for cards that are close to a bingo. For example, if one of the cards 20-26 has four out of five of the squares necessary to form one of the predetermined bingo patterns when a bingo is called, which is termed herein as a "near-bingo," a prize is awarded to that card. A near-bingo is defined for purposes of this explanation of the concept as a card that lacks one mark of being a Bingo, e.g. it has 4 marks in at least one line or has 3 corners marked.

As it will be appreciated, it is generally desirable that the near-bingo prizes will be much smaller than the bingo prize as shown in the Tables 1-3. The shaded columns in the tables represent the bingo prize and the near bingo prize. It will also be appreciated that the data in the columns labeled Bingo Prize and Near-Bingo Prize can be changed by the game designers to construct a particular prize structure.

In the embodiments of the concept shown in Tables 1-3, the Near Bingo Prize values, along with the Bingo Prizes are functions of the number of balls drawn to get Bingo. In Tables 1 and 2 the Near-Bingo Prize is a constant at 20 coins and in Table 3 the Near-Bingo prize generally declines as the number of balls drawn to get Bingo increases.

TABLE 1

Results of 10,000 50-Player Games with Near-Bingo Prize using BingoDistance Card Drop Strategy

| Bingo @ Ball | Games | Bingos | Near Bingos | Coins In | Bingo Prize | Near-Bingo Prize | Bingo Coin Out | Near Bingo CoinOut | Total Coin Out |
|---|---|---|---|---|---|---|---|---|---|
| NoBingo | 60 | 0 | 0 | 51,515 | 0 | 0 | 0 | 0 | 0 |
| 4 | 22 | 22 | 75 | 16,753 | 20,000 | 20 | 440,000 | 1,500 | 441,500 |
| 5 | 84 | 88 | 513 | 64,126 | 10,000 | 20 | 880,000 | 10,260 | 890,260 |
| 6 | 182 | 194 | 1,243 | 138,650 | 5,000 | 20 | 970,000 | 24,860 | 994,860 |
| 7 | 328 | 365 | 2,734 | 295,504 | 2,500 | 20 | 912,500 | 54,680 | 967,180 |
| 8 | 561 | 615 | 5,204 | 502,649 | 1,500 | 20 | 922,500 | 104,080 | 1,026,580 |
| 9 | 765 | 859 | 8,186 | 681,900 | 1,000 | 20 | 859,000 | 163,720 | 1,022,720 |
| 10 | 882 | 1,028 | 7,697 | 817,658 | 500 | 20 | 514,000 | 153,940 | 667,940 |
| 11 | 816 | 911 | 6,709 | 755,084 | 500 | 20 | 455,500 | 134,180 | 589,680 |
| 12 | 682 | 782 | 5,714 | 631,804 | 500 | 20 | 391,000 | 114,280 | 505,280 |
| 13 | 597 | 680 | 4,755 | 561,573 | 250 | 20 | 170,000 | 95,100 | 265,100 |
| 14 | 597 | 678 | 4,604 | 559,486 | 250 | 20 | 169,500 | 92,080 | 261,580 |
| 15 | 498 | 549 | 3,699 | 465,802 | 250 | 20 | 137,250 | 73,980 | 211,230 |
| 16 | 441 | 491 | 3,189 | 419,287 | 100 | 20 | 49,100 | 63,780 | 112,880 |
| 17 | 422 | 474 | 2,880 | 398,791 | 100 | 20 | 47,400 | 57,600 | 105,000 |
| 18 | 386 | 441 | 2,618 | 364,540 | 100 | 20 | 44,100 | 52,360 | 96,460 |
| 19 | 360 | 408 | 2,287 | 343,171 | 100 | 20 | 40,800 | 45,740 | 86,540 |
| 20 | 278 | 308 | 1,642 | 263,146 | 100 | 20 | 30,800 | 32,840 | 63,640 |
| 21 | 263 | 284 | 1,452 | 247,765 | 100 | 20 | 28,400 | 29,040 | 57,440 |
| 22 | 211 | 235 | 1,130 | 201,481 | 100 | 20 | 23,500 | 22,600 | 46,100 |
| 23 | 174 | 199 | 975 | 166,888 | 100 | 20 | 19,900 | 19,500 | 39,400 |
| 24 | 162 | 182 | 850 | 154,285 | 100 | 20 | 18,200 | 17,000 | 35,200 |
| 25 | 159 | 186 | 796 | 153,033 | 100 | 20 | 18,600 | 15,920 | 34,520 |
| 26 | 141 | 155 | 613 | 133,301 | 100 | 20 | 15,500 | 12,260 | 27,760 |
| 27 | 152 | 169 | 647 | 143,920 | 100 | 20 | 16,900 | 12,940 | 29,840 |
| 28 | 115 | 132 | 486 | 110,583 | 100 | 20 | 13,200 | 9,720 | 22,920 |
| 29 | 68 | 74 | 221 | 63,661 | 100 | 20 | 7,400 | 4,420 | 11,820 |
| 30 | 91 | 103 | 282 | 85,244 | 100 | 20 | 10,300 | 5,640 | 15,940 |
| >30 | 503 | 561 | 1,110 | 469,392 | 100 | 20 | 56,100 | 22,200 | 78,300 |
| Totals | 10,000 | 11,173 | 72,311 | 9,260,992 | | | 7,261,450 | 1,446,220 | 8,707,670 |
| | Win Freq 1: 6.0 | | | | % Return | | 78.4% | 15.6% | 94.0% |

TABLE 2

Results of 10,000 10-Player Games with Near-Bingo Prize using BingoDistance Card Drop Strategy

| Bingo @ Ball | Games | Bingos | Near Bingos | Coins In | Bingo Prize | Near-Bingo Prize | Bingo Coin Out | Near Bingo CoinOut | Total Coin Out |
|---|---|---|---|---|---|---|---|---|---|
| NoBingo | 2,129 | 0 | 0 | 365,983 | 0 | 0 | 0 | 0 | 0 |
| 4 | 1 | 1 | 0 | 158 | 20,000 | 20 | 20,000 | 0 | 20,000 |
| 5 | 16 | 16 | 17 | 2,457 | 10,000 | 20 | 160,000 | 340 | 160,340 |
| 6 | 38 | 39 | 63 | 5,795 | 5,000 | 20 | 195,000 | 1,260 | 196,260 |
| 7 | 66 | 70 | 127 | 12,105 | 2,500 | 20 | 175,000 | 2,540 | 177,540 |
| 8 | 128 | 132 | 300 | 23,401 | 1,500 | 20 | 198,000 | 6,000 | 204,000 |
| 9 | 206 | 215 | 479 | 37,454 | 1,000 | 20 | 215,000 | 9,580 | 224,580 |
| 10 | 273 | 282 | 548 | 52,521 | 200 | 20 | 56,400 | 10,960 | 67,360 |
| 11 | 232 | 240 | 428 | 44,569 | 200 | 20 | 48,000 | 8,560 | 56,560 |
| 12 | 237 | 243 | 437 | 45,405 | 200 | 20 | 48,600 | 8,740 | 57,340 |
| 13 | 221 | 224 | 391 | 43,174 | 100 | 20 | 22,400 | 7,820 | 30,220 |
| 14 | 222 | 233 | 371 | 43,675 | 100 | 20 | 23,300 | 7,420 | 30,720 |
| 15 | 211 | 220 | 385 | 41,711 | 100 | 20 | 22,000 | 7,700 | 29,700 |
| 16 | 226 | 234 | 369 | 45,311 | 75 | 20 | 17,550 | 7,380 | 24,930 |
| 17 | 237 | 245 | 413 | 47,820 | 75 | 20 | 18,375 | 8,260 | 26,635 |
| 18 | 222 | 229 | 376 | 44,851 | 75 | 20 | 17,175 | 7,520 | 24,695 |
| 19 | 212 | 216 | 293 | 42,982 | 75 | 20 | 16,200 | 5,860 | 22,060 |
| 20 | 245 | 249 | 369 | 50,009 | 75 | 20 | 18,675 | 7,380 | 26,055 |
| 21 | 225 | 227 | 326 | 45,965 | 75 | 20 | 17,025 | 6,520 | 23,545 |
| 22 | 212 | 217 | 309 | 44,274 | 75 | 20 | 16,275 | 6,180 | 22,455 |
| 23 | 220 | 226 | 324 | 45,972 | 75 | 20 | 16,950 | 6,480 | 23,430 |
| 24 | 231 | 238 | 302 | 47,592 | 75 | 20 | 17,850 | 6,040 | 23,890 |
| 25 | 231 | 235 | 293 | 48,473 | 75 | 20 | 17,625 | 5,860 | 23,485 |
| 26 | 229 | 233 | 253 | 47,514 | 75 | 20 | 17,475 | 5,060 | 22,535 |
| 27 | 211 | 216 | 243 | 44,157 | 75 | 20 | 16,200 | 4,860 | 21,060 |
| 28 | 218 | 230 | 228 | 45,970 | 75 | 20 | 17,250 | 4,560 | 21,810 |

TABLE 2-continued

Results of 10,000 10-Player Games with Near-Bingo Prize using BingoDistance Card Drop Strategy

| Bingo @ Ball | Games | Bingos | Near Bingos | Coins In | Bingo Prize | Near-Bingo Prize | Bingo Coin Out | Near Bingo CoinOut | Total Coin Out |
|---|---|---|---|---|---|---|---|---|---|
| 29 | 232 | 237 | 231 | 48,696 | 75 | 20 | 17,775 | 4,620 | 22,395 |
| 30 | 194 | 199 | 185 | 40,392 | 75 | 20 | 14,925 | 3,700 | 18,625 |
| >30 | 2,675 | 2,743 | 1,392 | 563,106 | 75 | 20 | 205,725 | 27,840 | 233,565 |
| Totals | 10,000 | 8,089 | 9,452 | 1,971,492 | | | 1,646,750 | 189,040 | 1,835,790 |
| | Win Freq 1: 5.7 | | | | % Return | | 83.5% | 9.6% | 93.1% |

TABLE 3

Results of 10,000 100-Player Games with Near-Bingo Prize using BingoDistance Card Drop Strategy

| Bingo @ Ball | Games | Bingos | Near Bingos | Coins In | Bingo Prize | Near-Bingo Prize | Bingo Coin Out | Near Bingo CoinOut | Total Coin Out |
|---|---|---|---|---|---|---|---|---|---|
| NoBingo | 14 | 0 | 0 | 23,879 | 0 | 0 | 0 | 0 | 0 |
| 4 | 31 | 35 | 305 | 47,019 | 20,000 | 500 | 700,000 | 152,500 | 852,500 |
| 5 | 136 | 148 | 1,403 | 207,645 | 10,000 | 200 | 1,480,000 | 280,600 | 1,760,600 |
| 6 | 324 | 352 | 3,723 | 494,415 | 5,000 | 100 | 1,760,000 | 372,300 | 2,132,300 |
| 7 | 602 | 701 | 9,573 | 1,080,601 | 2,500 | 50 | 1,752,500 | 478,650 | 2,231,150 |
| 8 | 907 | 1,101 | 15,989 | 1,618,427 | 1,500 | 30 | 1,651,500 | 479,670 | 2,131,170 |
| 9 | 1,161 | 1,421 | 23,698 | 2,062,022 | 1,000 | 20 | 1,421,000 | 473,960 | 1,894,960 |
| 10 | 1,262 | 1,609 | 20,204 | 2,320,361 | 750 | 15 | 1,206,750 | 303,060 | 1,509,810 |
| 11 | 1,021 | 1,248 | 15,650 | 1,869,140 | 750 | 15 | 936,000 | 234,750 | 1,170,750 |
| 12 | 825 | 1,063 | 12,596 | 1,512,270 | 750 | 15 | 797,250 | 188,940 | 986,190 |
| 13 | 684 | 875 | 9,772 | 1,269,062 | 500 | 10 | 437,500 | 97,720 | 535,220 |
| 14 | 541 | 670 | 7,451 | 1,001,130 | 500 | 10 | 335,000 | 74,510 | 409,510 |
| 15 | 441 | 569 | 5,745 | 813,750 | 25 | 2 | 14,225 | 11,490 | 25,715 |
| 16 | 388 | 477 | 5,084 | 726,425 | 25 | 2 | 11,925 | 10,168 | 22,093 |
| 17 | 307 | 376 | 3,396 | 565,375 | 25 | 2 | 9,400 | 6,792 | 16,192 |
| 18 | 261 | 326 | 3,017 | 483,081 | 25 | 2 | 8,150 | 6,034 | 14,184 |
| 19 | 184 | 217 | 2,072 | 344,218 | 25 | 2 | 5,425 | 4,144 | 9,569 |
| 20 | 175 | 217 | 1,925 | 326,939 | 25 | 2 | 5,425 | 3,850 | 9,275 |
| 21 | 142 | 176 | 1,331 | 262,513 | 25 | 2 | 4,400 | 2,662 | 7,062 |
| 22 | 117 | 138 | 1,113 | 218,576 | 25 | 2 | 3,450 | 2,226 | 5,676 |
| 23 | 87 | 103 | 672 | 159,702 | 25 | 2 | 2,575 | 1,344 | 3,919 |
| 24 | 79 | 91 | 553 | 144,429 | 25 | 2 | 2,275 | 1,106 | 3,381 |
| 25 | 64 | 82 | 536 | 119,448 | 25 | 2 | 2,050 | 1,072 | 3,122 |
| 26 | 52 | 65 | 335 | 95,916 | 25 | 2 | 1,625 | 670 | 2,295 |
| 27 | 41 | 48 | 250 | 75,228 | 25 | 2 | 1,200 | 500 | 1,700 |
| 28 | 30 | 37 | 166 | 54,884 | 25 | 2 | 925 | 332 | 1,257 |
| 29 | 33 | 36 | 208 | 61,483 | 25 | 2 | 900 | 416 | 1,316 |
| 30 | 15 | 17 | 91 | 27,490 | 25 | 2 | 425 | 182 | 607 |
| >30 | 76 | 93 | 218 | 137,918 | 25 | 2 | 2,325 | 436 | 2,761 |
| Totals | 10,000 | 12,291 | 147,076 | 18,123,346 | | | 12,554,200 | 3,190,084 | 15,744,284 |
| | Win Freq 1: 6.3 | | | | % Return | | 69.3% | 17.6% | 86.9% |

Of particular note, the bingo prize structures described above have a significant advantage in that it can substantially increase the frequency of player wins while still providing substantial jackpots and a good return to the game proprietor. In the examples of the prize structures above, the win frequency is approximately one in six. In fact by using a bingo prize structure of this type it becomes possible to closely replicate the prize structure of other casino games such as spinning reel slot machines. Additionally, this type of prize structure is particularly attractive in the bingo games where after the initial purchase of one or more cards, the game requires the players to pay a predetermined amount per card for the next ball or series of balls and thus has the option of only paying for cards that appear to be close to winning.

Another embodiment of the near bingo game described above includes implementing the near bingo operation in a manually played game. For example, the bingo cards 20-26 can be a set of cardboard bingo cards that are randomly distributed to the players in the game. As with conventional bingo games, the game can require that the players pay for each card that they received. The balls 58 instead of being simulated balls can be actual balls that are drawn or "dropped" from a drawing mechanism such as a cage or a rotating container that can be a mechanical embodiment of at least a portion of the system controller 10. Pay tables included in the prize structures of the type shown in Tables 1-3 above can be used to award the bingo and near bingo prizes.

Below is described the preferred embodiment of a method that can be implemented in an apparatus or system of the type shown in FIG. 1 for determining if any of the cards in an electronic bingo game have a winning bingo pattern. The data structure and notation used to describe the preferred embodiment of this method are as follows:

Table 1 displays a sample of bingo card. Here, the center cell, slightly greyed out, has a value of 99. This cell is a free cell and is taken as marked before any balls are drawn—the number 99 plays no role; it serves only as a place holder

TABLE 1

Sample Bingo Card

| B | I | N | G | O |
|---|---|---|---|---|
| 7 | 23 | 45 | 58 | 66 |
| 6 | 29 | 33 | 46 | 70 |
| 2 | 25 | 99 | 50 | 62 |
| 12 | 18 | 42 | 47 | 74 |
| 10 | 17 | 32 | 52 | 63 |

This two dimensional array is stored in a one dimension vector, suitable for storing as a record in a relational database, using the cell numbering shown in Table 2.

TABLE 2

Numbering of Bingo Card Cells

| B | I | N | G | O |
|---|---|---|---|---|
| 1 | 6 | 11 | 16 | 21 |
| 2 | 7 | 12 | 17 | 22 |
| 3 | 8 | 13 | 18 | 23 |
| 4 | 9 | 14 | 19 | 24 |
| 5 | 10 | 15 | 20 | 25 |

The one dimensional representation of the card of Table 1 is shown in Table 3

TABLE 3

One Dimensional Vector Representation of Bingo Card

| | Cell Number | | | | | | | | | | | | | | | | | | | | | | | | |
|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| Cell Content | 7 | 6 | 2 | 12 | 10 | 23 | 29 | 25 | 18 | 17 | 45 | 33 | 99 | 42 | 32 | 58 | 46 | 50 | 47 | 52 | 66 | 70 | 62 | 74 | 63 |

In the preferred embodiment, computer intensive work done by the game logic 56 in the computer or controller 10 in playing a bingo game can be summarized in the 3 three following steps:

1. Draw a ball;
2. Mark those cells on the active cards that have that ball number; and
3. Check all the cards to see if a Bingo has occurred.

Table 4 shows a typical ball draw sequence. The greyed out numbers appear on the sample card of Tables 1 and 3.

TABLE 4

Example Ball Draw Sequence

| Draw Sequence Number | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Ball Drawn | 24 | 21 | 10 | 28 | 57 | 66 | 44 | 50 | 62 | 34 | 46 | 1 | 41 | 18 |

Table 5 shows the marked cell numbers of the bingo card after the ball draw of Table 4. Note that only the cell numbers not the cell content is referred to here as only the marked cell numbers are required to determine if this card has a bingo. See Table 6 where the same data is displayed in conventional two dimensional form.

TABLE 5

Figure 4:
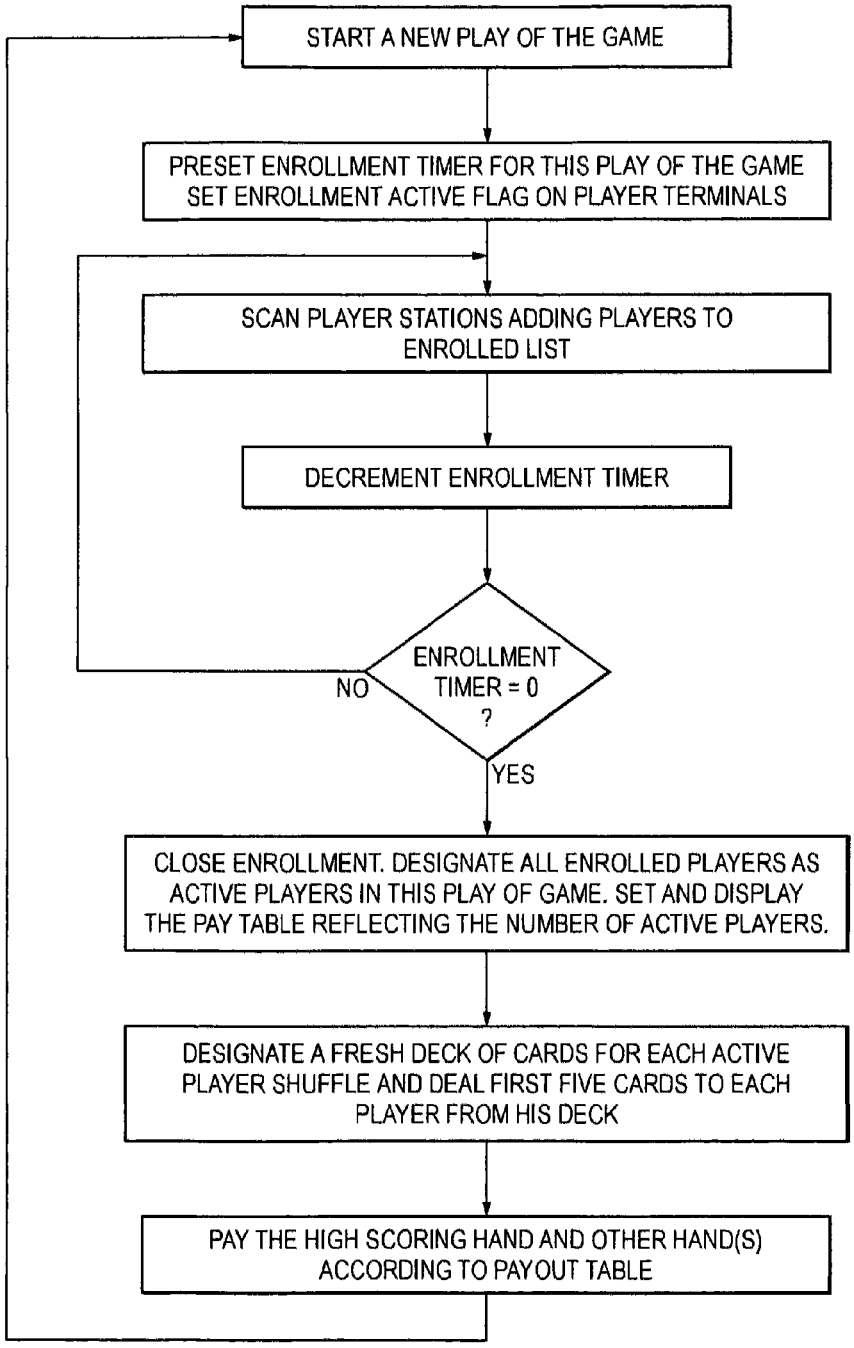
FIG. 4 is a flow chart illustrating the operation of a multiplayer gaming system of the type shown in FIG. 1 for a showdown poker game using a separate deck for each player.

Marked Bingo Card after Ball Draw of FIG. 4

| Cell Number | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| Cell Number | 7 | 6 | 2 | 12 | 10 | 23 | 29 | 25 | 18 | 17 | 45 | 33 | 99 | 42 | 32 | 58 | 46 | 50 | 47 | 52 | 66 | 70 | 62 | 74 | 63 |

Table 6 illustrates the same data displayed in conventional two dimensional form such as on one of the cards 34-50 displayed on one of the displays 32.

TABLE 6

Marked Sample Bingo Card

| B | I | N | G | O |
|---|---|---|---|---|
| 7 | 23 | 45 | 58 | 66 |
| 6 | 29 | 33 | 46 | 70 |
| 2 | 25 | 99 | 50 | 62 |
| 12 | 18 | 42 | 47 | 74 |
| 10 | 17 | 32 | 52 | 63 |

The next step in this example of the process involves marking of the Bingo cards. In this example, a vector of 25 bits is sufficient to store the card mark data for a single bingo card: bit[i] is set to 1 if and only if cell[i] on the card is marked. Here, the card mark data bit vector is stored in a 32 bit integer variable and updated as the balls are drawn. Initially all bits of the mark record are 0 except the 13 bit which corresponds to the free square at cell 13 as shown in Table 7.1. The mark record is updated by the game logic 56 after each ball drawn by setting to 1 the bit corresponding to the cell containing the number of the drawn ball. After 5 balls have been drawn in the sequence of Table 4, the bit corresponding to the 10 ball on the record for the card described in Tables 1 and 3 is marked. As the number 10 occupies cell 5, the 5 bit is set to 1 as shown in Table 7.2. This process continues as the other balls are drawn, terminating when a bingo has been achieved after 14 balls have been drawn.

TABLE 7.1

Mark Record prior to any balls being drawn

| | Bit Number | | | | | | | | | | | | | | | | | | | | | | | | |
|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| Bit Value | 0 | 0 | 0 | 0 | 0 | 0 | 0 | 0 | 0 | 0 | 0 | 0 | 1 | 0 | 0 | 0 | 0 | 0 | 0 | 0 | 0 | 0 | 0 | 0 | 0 |

TABLE 7.2

Mark Record after 5 balls have been drawn

| | Bit Number | | | | | | | | | | | | | | | | | | | | | | | | |
|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| Bit Value | 0 | 0 | 0 | 0 | 1 | 0 | 0 | 0 | 0 | 0 | 0 | 0 | 1 | 0 | 0 | 0 | 0 | 0 | 0 | 0 | 0 | 0 | 0 | 0 | 0 |

TABLE 7.3

Mark Record after 10 balls have been drawn

| | Bit Number | | | | | | | | | | | | | | | | | | | | | | | | |
|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| Bit Value | 0 | 0 | 0 | 0 | 1 | 0 | 0 | 0 | 0 | 0 | 0 | 0 | 1 | 0 | 0 | 0 | 0 | 0 | 0 | 0 | 1 | 0 | 1 | 0 | 0 |

TABLE 7.4

Mark Record after 14 balls have been drawn

| | Bit Number | | | | | | | | | | | | | | | | | | | | | | | | |
|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| Bit Value | 0 | 0 | 0 | 0 | 1 | 0 | 0 | 0 | 1 | 0 | 0 | 0 | 1 | 0 | 0 | 0 | 1 | 0 | 0 | 0 | 1 | 0 | 1 | 0 | 0 |

Determining that Bingo has been achieved is the next task of the process performed in the game logic 56 of the controller 10. The first step in this representative example involves marking the bingo cards in a database. In the preferred process, the card mark data is stored as a WorkingDeck Table in the digital memory 66. It includes two fields of interest:

CardId, containing the unique id of the card, and marks, containing the current card mark vector data in a single long integer Each bingo card mark vector starts out with only the 13 bit set to 1 as in Table7.1 where:

Card1V=the mark bit vector for card 1

$UnitVector_i$=vector that has bit i set to 1 and all other bits 0. Then cell[i] is marked on Card1V by setting Card1V=bit-wise- or (Card1V, $UnitVector_i$)

Another table, termed bitMapCards, can be stored in the digital memory 66. This table stores the same information contained in Table CardFace (Table 3), but in a form that simplifies the card marking operation.

Table 8 below is an illustration of a record for one card in the bitMapCards table.

TABLE 8

Record for Card 1 in bitMapCards Table

| Name | Content |
|---|---|
| Id | 1 |
| LocOf1 | 0 |
| LocOf2 | 8 |
| LocOf3 | 0 |
| LocOf4 | 0 |
| LocOf5 | 0 |
| LocOf6 | 4 |
| LocOf7 | 2 |
| LocOf8 | 0 |
| LocOf9 | 0 |
| LocOf10 | 32 |
| LocOf11 | 0 |
| LocOf12 | 16 |
| LocOf13 | 0 |
| LocOf14 | 0 |
| LocOf15 | 0 |
| LocOf16 | 0 |
| LocOf17 | 1024 |
| LocOf18 | 512 |
| LocOf19 | 0 |
| LocOf20 | 0 |
| LocOf21 | 0 |
| LocOf22 | 0 |
| LocOf23 | 64 |
| LocOf24 | 0 |
| LocOf25 | 256 |
| LocOf26 | 0 |
| LocOf27 | 0 |
| LocOf28 | 0 |
| LocOf29 | 128 |
| LocOf30 | 0 |
| LocOf31 | 0 |
| LocOf32 | 32768 |
| LocOf33 | 4096 |
| LocOf34 | 0 |
| LocOf35 | 0 |
| LocOf36 | 0 |
| LocOf37 | 0 |
| LocOf38 | 0 |
| LocOf39 | 0 |
| LocOf40 | 0 |
| LocOf41 | 0 |
| LocOf42 | 16384 |
| LocOf43 | 0 |
| LocOf44 | 0 |
| LocOf45 | 2048 |
| LocOf46 | 131072 |

TABLE 8-continued

Record for Card 1 in bitMapCards Table

| Name | Content |
|---|---|
| LocOf47 | 524288 |
| LocOf48 | 0 |
| LocOf49 | 0 |
| LocOf50 | 262144 |
| LocOf51 | 0 |
| LocOf52 | 1048576 |
| LocOf53 | 0 |
| LocOf54 | 0 |
| LocOf55 | 0 |
| LocOf56 | 0 |
| LocOf57 | 0 |
| LocOf58 | 65536 |
| LocOf59 | 0 |
| LocOf60 | 0 |
| LocOf61 | 0 |
| LocOf62 | 8388608 |
| LocOf63 | 33554432 |
| LocOf64 | 0 |
| LocOf65 | 0 |
| LocOf66 | 2097152 |
| LocOf67 | 0 |
| LocOf68 | 0 |
| LocOf69 | 0 |
| LocOf70 | 4194304 |
| LocOf71 | 0 |
| LocOf72 | 0 |
| LocOf73 | 0 |
| LocOf74 | 16777216 |
| LocOf75 | 0 |

As described below, the structure of the bitMapCards table is useful for the efficient marking operation. A description of the preferred configuration of the bitMapCards table follows:

The field named LocOf2, for example, contains a bit vector with the location, on card 1, of the symbol 2. The value stored in this field is $8=2^3$, i.e. only the 3 bit is set, so that this is the vector $UnitVector_3$. Referring back to Table 5, the content of cell[3] is the symbol 2. Similarly the contents of field LocOf10 contains the value $32=2^5=UnitVector_5$, the vector with only the 5 bit set. Again referring back to Table 5, the content of cell[5] is the symbol 10. Here, the assignment rule is: field LocOf#N contains 0 if symbol #N is not on the card and UnitVector) where j is the cell on the card containing the symbol #N when symbol #N is on the card.

The preferred embodiment of the table, the WorkingDeck Table contains the card mark vector data for the active cards throughout the play of the game. In this embodiment, it includes two fields:

CardId, containing the unique id of the card; and marks, containing the current card mark vector data in a single long integer.

One advantage of the bitMapCards table as described is that when ball #N (2 in this case) is drawn it is possible to update all active cards in the WorkingDeck table with a single access to the database by, for example, using a SQL statement such as:

Update workingdeck, bitmapcards set workingdeck.marks=bitwiseOr(bitmapcards. LocOf2, workingdeck.marks)

Where Bitmapcards.CardId=Workingdeck.CardId

In checking for a Bingo, winning bingo patterns can also be represented as bit vectors as shown in a Table 9 below. The column integer value is the decimal value of the number whose binary representation is given by the bit vector. For example $Column1=2^1+2^2+2^3+2^4+2^5=62$.

TABLE 9

Bingo Winners Bitmaps

| | Bit Number | | | | | | | | | | | | | | | | | | | | | | | | | Integer |
|---|---|---|---|---|---|---|---|---|---|---|---|---|---|---|---|---|---|---|---|---|---|---|---|---|---|---|
| Bingo Name | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | Value |
| Column 1 (B) | 1 | 1 | 1 | 1 | 1 | | | | | | | | | | | | | | | | | | | | | 62 |
| Column 2 (I) | | | | | | 1 | 1 | 1 | 1 | 1 | | | | | | | | | | | | | | | | 1984 |
| Column 3 (N) | | | | | | | | | | | 1 | 1 | 1 | 1 | 1 | | | | | | | | | | | 63488 |
| Column 4 (G) | | | | | | | | | | | | | | | | 1 | 1 | 1 | 1 | 1 | | | | | | 2031616 |
| Column 5 (O) | | | | | | | | | | | | | | | | | | | | | 1 | 1 | 1 | 1 | 1 | 65011712 |
| Row 1 | 1 | | | | | 1 | | | | | 1 | | | | | 1 | | | | | 1 | | | | | 2164802 |
| Row 2 | | 1 | | | | | 1 | | | | | 1 | | | | | 1 | | | | | 1 | | | | 4329604 |
| Row 3 | | | 1 | | | | | 1 | | | | | 1 | | | | | 1 | | | | | 1 | | | 8659208 |
| Row 4 | | | | 1 | | | | | 1 | | | | | 1 | | | | | 1 | | | | | 1 | | 17318416 |
| Row 5 | | | | | 1 | | | | | 1 | | | | | 1 | | | | | 1 | | | | | 1 | 34636832 |
| Diagonal 1 | 1 | | | | | | 1 | | | | | | 1 | | | | | | 1 | | | | | | 1 | 34087042 |
| Diagonal 2 | | | | | 1 | | | | 1 | | | | 1 | | | | 1 | | | | 1 | | | | | 2236960 |
| Four Corners | 1 | | | | 1 | | | | | | | | 1 | | | | | | | | 1 | | | | 1 | 35659810 |

To test for a particular winner in this particular example, such as the Column1 winner, each of the cells 1, 2, 3, 4, 5 must be marked on the test card, that is, each of these bits must be set in the mark vector for the test card.

With this notation

Column1Bingo(Card1)=True if Card1 has a column 1 bingo marked,

False otherwise

Column1WinV=Column1 Winner Bit Vector

Card1V=the mark bit vector for card 1

Column1 Bingo(Card1)=(bit-wise- and (Column1WinV, Card1V)=Column1WinV)

That is when masking the Card1 mark bit vector with the Column1 Winner vector using the bit-wise- and operation, it is apparent that the Column1 Winner bit vector, i.e. every bit spot in column 1 has been marked. Using this notation it is possible to select into the Bingos Table all the cards from Workingdeck that have a column1 Bingo in a single SQL statement. Where, as above, 62 is the column1 winner bit vector, the SQL statement can be:

Select CardId, Marks into Bingos from WorkingDeck where Bitwiseand(62,Marks)=62

As a result, all the cards in the WorkingDeck table can be checked for all possible bingos in the single SQL statement below. Those that contain a bingo then can be placed in a Bingos table. The numbers 62, 1984, 63488, etc. are the bitmap vectors for the bingo winners in Table 9. Note that Additional fields can be included in the Bingos table. The exemplary SQL statement is:

Select CardId, Marks into Bingos from WorkingDeck where

Bitwiseand(62,Marks)=62 Or—

Bitwiseand(1984,Marks)=1984 Or

Bitwiseand(63488,Marks)=63488 Or

Bitwiseand(2031616,Marks)=2031616 Or

Bitwiseand(65011712,Marks)=65011712 Or

Bitwiseand(2164802,Marks)=2164802 Or

Bitwiseand(4329604,Marks)=4329604 Or

Bitwiseand(8659208,Marks)=8659208 Or

Bitwiseand(17318416,Marks)=17318416 Or

Bitwiseand(34636832,Marks)=34636832 Or

Bitwiseand(34087042,Marks)=34087042 Or

Bitwiseand(2236960,Marks)=2236960 Or

Bitwiseand(35659810,Marks)=35659810

The method of constructing an apparatus and method for evaluating or checking each card in a bingo game using the bit marked card technique and vector operations with the advantage of being able to use a SQL type language as described above makes it possible to determine winning bingo cards in an expeditious manner and is particularly useful for an internet based a game that may include many thousands of cards.

The method and apparatus as described above has a particular advantage in an internet type game where there can be thousands of cards such as the cards 34-50. In an ordinary bingo game, marking the cards 34-50 and checking for Bingo is carried out at each player's location or computer, so that efficiency in marking cards and determining whether a bingo has occurred is ordinarily not a major consideration. By contrast, in an Internet bingo game, both of these operations are usually carried out at the central computer, such as the controller 10, for the entire population of cards in the game such as cards 34-50. This advantage of the described method arises by virtue of using the database manager, to mark and check a large number of cards in single operations.

FIG. 3 is a block diagram depicting a multiplayer gaming system 110 that provides a representative example of an environment in which the below described games and prize structures can be implemented. In this depiction a casino type environment is used as the example and includes a casino computer 112. Connected to the casino computer 112, as represented by a set of communication channels or lines 114-124, are, in this embodiment, a set of player operated machines 126-136. The smaller representations of the terminals 128-134 is intended to illustrate the fact that the number of the terminals 126-136 connected to the casino controller 112 can be variable and in the case of an internet implementation can be very large. The player operated machines 126-136 can be configured in various ways including conventional casino type video gaming machines. The machines 126 and 136 are depicted in FIG. 3 in expanded form to illustrate various features that can be included in the machines 126-136 including a housing 138; a set of player controls of a first type 140 on the terminal 126 and a second type of player controls 142 on the terminal 136. For example, the player controls 140 can be a keyboard where the player terminal 126 is a personal computer. Also as shown on the terminal 136, is a slot 144 for dispensing payouts to the player of the terminal 136 that can be included where for instance the player terminal 136 is a video poker machine. Preferably, included or associated with each of the terminals 126-136 is a video display 146 for displaying the game being played by the player. The information conveyed to the player on the display 146 can include the player's poker hand and other information relating to game play.

It should be understood that the system shown in FIG. 3 is provided as a representative example of a gaming system that can make use of the methods described below. For instance, an Internet arrangement can be used to implement such a system where personal computers can serve as the player operated machines 126-136 and the lines 114-124 represent Internet connections with a control system resident on a server that functions as the system computer 112. Alternatively, a casino type system can be used where the player terminals 126-136 are conventional video poker machines that are hardwired or connected wirelessly as indicated by the lines 114-124 to the controller 112 which in a casino can be a computer.

FIG. 4 is a flow chart illustrating a first embodiment of the operation of the system 110 implementing a multiplayer competitive showdown poker game. In this game, a pay table is selected according to the number of players or terminals 126-136 enrolled or active in the game. Also in this embodiment, each player receives five cards after a deck associated with his terminal 126-136 is shuffled.

FIG. 5 is a table providing an example of a basic prize structure that can be used with the winner take all showdown poker game having players enrolled on twenty of the terminals 126-136 utilizing the process shown in FIG. 4. The ability to provide very high payouts in this process using individual decks of cards for each player is demonstrated in the first and second columns of FIG. 5. Here as depicted in the first and second columns, the highest payout is 100,000 monetary units for the highest score, a Royal Flush, where the initial bet is one monetary unit per player. In this case as shown in the third column, the probability of a Royal Flush where the game uses a separate deck for each of the 20 players is 0.0000308. As indicated in the fourth column of FIG. 5, this prize structure will on average return to the players 19.43 monetary units for the twenty units played giving the game proprietor a return of 0.57 monetary units for each poker game played by 20 players. It should also be noted that, in line with the process shown in FIG. 4, this embodiment contemplates changing the prize structure based on the number of players or terminals 126-136 enrolled in the game where the payouts can increase as a function of an increasing number of terminals enrolled in the game.

Figure 6:
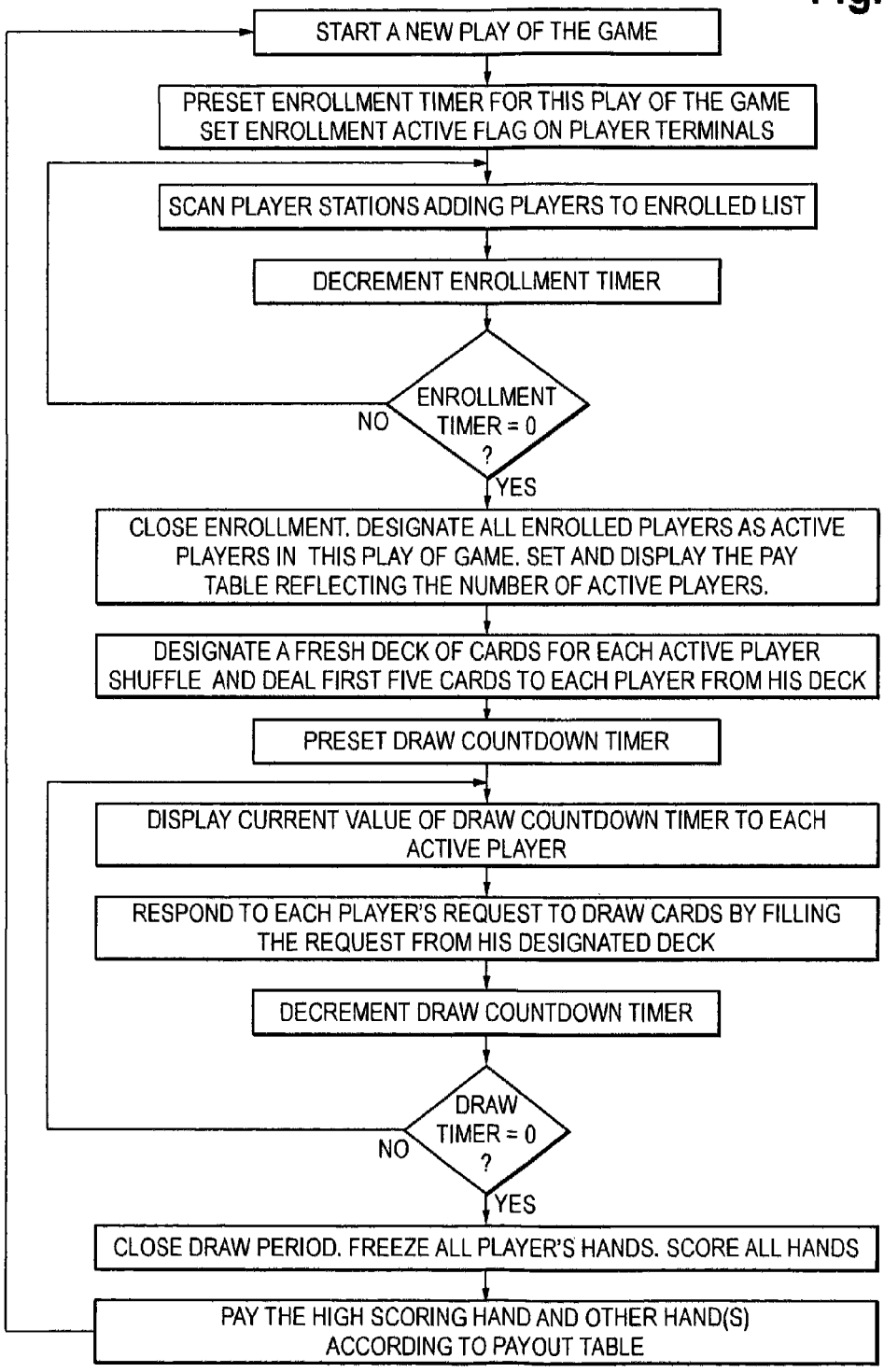
FIG. 6 is a flow chart illustrating the operation of a multiplayer gaming system of the type shown in FIG. 3 for a draw poker game using a separate deck for each player.

FIG. 6 is a flow chart illustrating a second embodiment of the operation of the system 110 in this case implementing a multiplayer competitive draw poker game. As with the process of FIG. 4, a pay table is selected according to the number of players or terminals 126-136 enrolled or active in the game. Also in this embodiment, each player receives five cards after a deck associated with his terminal is shuffled. However, the embodiment FIG. 6 further includes a mechanism for permitting the players to draw additional cards from their decks.

FIG. 7 is a table providing an example of a basic prize structure that can be used with the winner take all draw poker game having players enrolled on twenty of the terminals 126-136 utilizing the process shown in FIG. 6. The very high payouts that are possible using this process are shown in the first and second columns of FIG. 7. In this example of a prize structure, the highest payout for the best hand in the game as shown in the first column is 8,000 monetary units for the highest score, a Royal Flush, where the initial bet is one monetary unit per player. In this case as depicted in the third column, the probability of the best hand payout, here a Royal Flush, where the game uses a separate deck for each of the 20 players is 0.0004951. As indicated in the fourth column of FIG. 7, this prize structure will on average return to the players 19.91 monetary units for the twenty units played. It should also be noted that, in line with the process shown in FIG. 6, this embodiment contemplates changing the prize structure based on the number of players or terminals 126-136 enrolled in the game where the payouts can increase as a function of an increasing number of terminals enrolled in the game.

FIG. 8 is a table providing an example of a hybrid prize structure in which some prizes are awarded only to the best hand and other prizes are awarded to every player having the appropriate hand, that can be used with a poker game having players enrolled on twenty of the terminals 126-136 utilizing the process shown in FIG. 6. The very high payouts that are possible using this process are shown in the first and fourth columns of FIG. 8. In this example of a prize structure, the highest payout for the best hand in the game is 8,000 monetary units for the highest score, a Royal Flush, where the initial bet is one monetary unit per player. In this case as shown in the third column, the probability of a Royal Flush where the game uses a separate deck for each of the 20 players is 0.00050. However, the prize structure of FIG. 8 additionally provides for payouts for hands other than the best hand. As shown in column 5, every player that obtains a Straight or Three of a Kind will also receive a payout. Here, it is four monetary units for a Straight or two units for Three of a Kind. In this example, as indicated in the sixth column of FIG. 8, this prize structure will on average return to the players 19.92 of the monetary units for the twenty units played. In line with the process shown in FIG. 6, this embodiment contemplates changing the prize structure based on the number of players or terminals 126-136 enrolled in the game where selected payouts such as for the best hand can increase as a function of an increasing number of terminals enrolled in the game.

FIG. 9 is a table providing an example of a prize structure where certain prize amounts are determined by scores of more than one hand. Again this prize structure can be used with a poker game having players enrolled on twenty of the terminals 126-136 utilizing the process shown in FIG. 6. The very high payouts that are possible using this process are shown in the first and sixth columns of FIG. 9. In this example of a prize structure, the highest payout for the best hand in the game is 100,000 monetary units for the highest score, a Royal Flush, where, as shown in column two, the second best hand in the game is a Royal Flush or a Straight Flush. Here, the amount of the best payout is dependent on both the score of the best hand and on the score of the second best hand. If the second best hand is four of a Kind, the best payout will be 20,000 monetary units. In this example of a prize structure, as shown in the fourth column, the joint probability of a Royal Flush where the second best hand is a Royal Flush or a Straight Flush is 1.3 parts per million. The pay structure also provides for payouts for certain of the second best hands as illustrated in column seven. As may be appreciated, the use of joint probabilities in multiplayer games as illustrated in FIG. 9 can provide for very high payouts as well as serving to effectively increase the granularity of game outputs thereby making it possible to design more flexible pay structures. This table also illustrates the provision for payouts to the second best hand.

Figure 10:
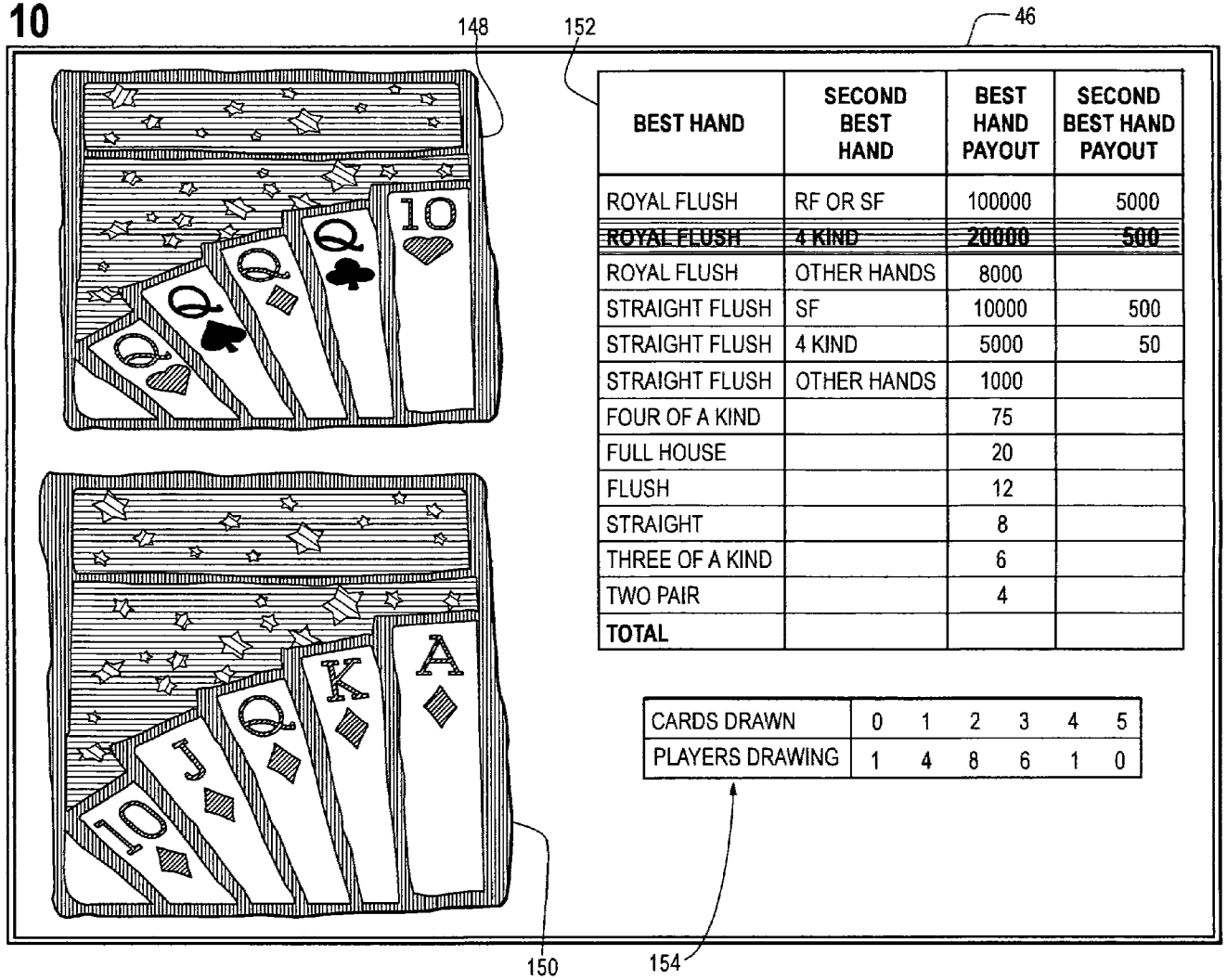
FIG. 10 is an illustration of the type of information that can be displayed on the terminals of FIG. 3 in connection with the games of FIG. 4 and FIG. 6.

FIG. 10 illustrates some of the information that can be displayed on the displays 146 of the player terminals 126-136. For example, the displays 146 can display at 148 the hand dealt for the player at that terminal; at 150 the best hand on any of the terminals 126-136 at the conclusion of the game; at 152 a pay table for the game; and for draw poker games of the type described in FIG. 6., at 154 a table providing the distribution of the number of cards drawn and the number of players drawing that number of card.

Also, the system of competitive gaming as described above can be added to an existing gaming system incorporating conventional autonomous video poker machines. For example in a casino environment, such as shown in FIG. 3 where the player terminals 126-136 are conventional autonomous or standalone video poker machines where the player plays an individual game of poker on his own machine and the casino controller 112 is a conventional computer collecting data from the terminals 126-136, one of the completive gaming systems described above can be added without having to supply additional hardware. In one embodiment the players can be given the option of playing the competitive game on their video poker machines 126-136 along with the autonomous or machine specific game. In this case, the display 146 can be used to display the competitive game information, for example the information shown in FIG. 10, as well as information relating to the individual poker game played on the video poker machines 126-136. There are a variety of ways that this information can be displayed to the players including having a separate window on the display 146 for the competitive game or multiplexing screens with the autonomous machine or individual game information on one screen and the competitive game information on another screen of the display 146. Separate displays can also be used. It should be also noted that the player controls 140 and 142 can be arranged such that the player has the option of electing to play only the autonomous machine or individual game; the competitive game only; or both the individual and the competitive game.

As indicated above, the competitive game can be implemented using the casino computer 112 to control the competitive game as well as the machine specific game. Here, the logic required to implement the competitive game can be added to the casino computer or controller 112 in the form of additional software. This approach makes it possible to substantially increase both the play value and the revenue on the existing hardware in a casino.

As depicted in FIG. 3, the competitive game can also be expanded beyond one venue, such as a particular casino. This can be accomplished by providing a central controller 156 as shown in FIG. 3 which is connected to the casino controller or computer 112 as indicated by a line 158. Local controllers, such as the casino controller 112, located in additional casinos or other gaming establishments can be connected to the central controller as indicated by a set of lines 160 such that the central controller 156 can be used to control the competitive game in additional venues. In this manner the number of terminals 126-136 used to play the competitive game can be greatly expanded thereby providing for much higher payouts for the competitive game.

Figure 11:
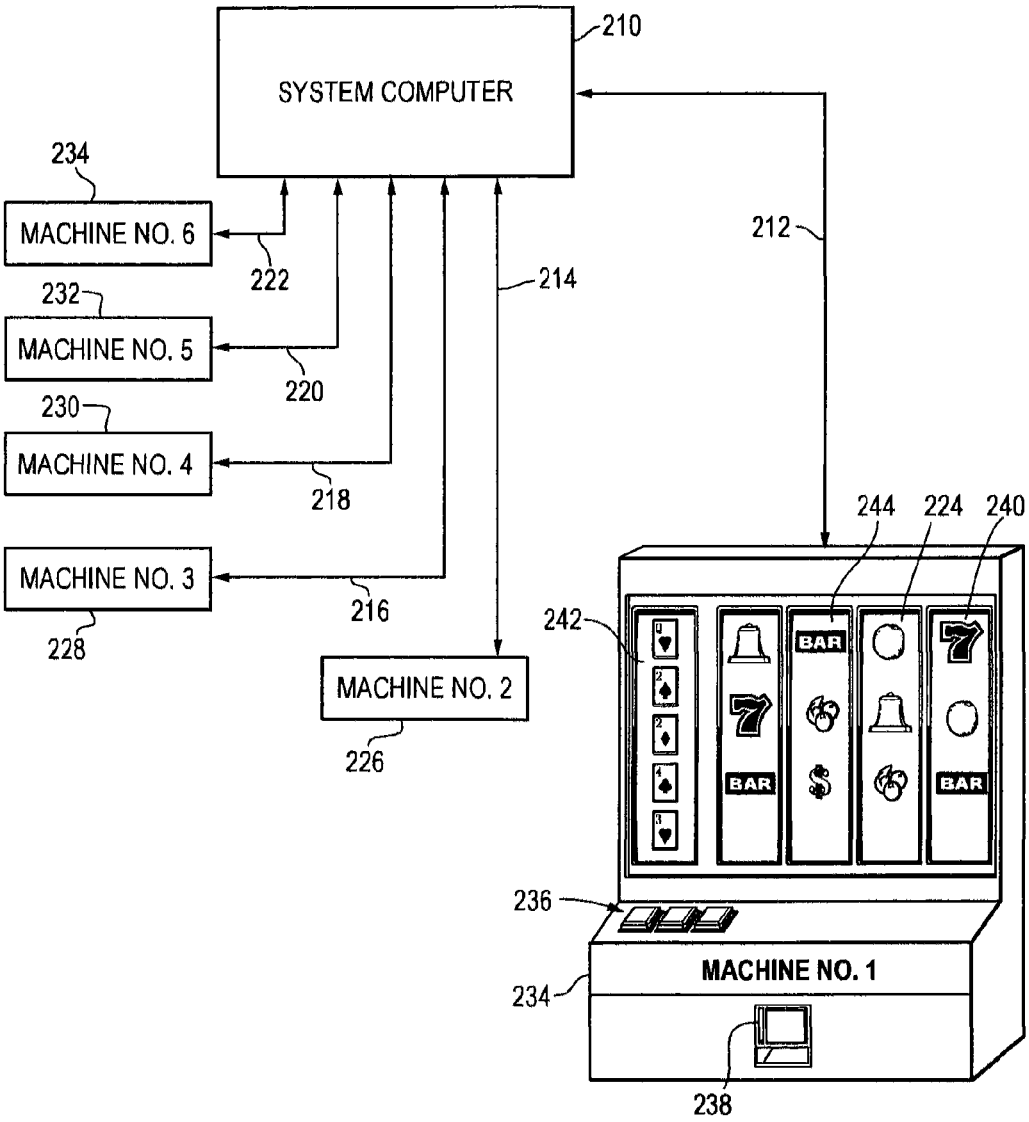
FIG. 11 is a block diagram of a multiplayer gaming system suitable for utilizing the described prize structure.

FIG. 11 is a block diagram of a multiplayer gaming system that provides a representative example of an environment in which the below described prize structure can be implemented. In this example, a central system computer 210 is used to control the system. Connected to the central computer 210, as represented by a set of communication lines 212-222, are, in this embodiment, a set of six player operated machines 224-232. The player operated machines 224-232 can be configured in various ways including conventional casino type video gaming machines. The first machine 224 is depicted in FIG. 1 in expanded form to illustrate various features of the machine 224 including a housing 234; a set of player controls 236; and a slot 238 for dispensing payouts to the player of the machine. Also, included in the machine 224 is a video display 240 that is divided into two portions: a first display 242 for displaying a the game being played by the player, in this case a game of five card stud poker where the five cards dealt to the player are shown on the display 242; and a second display 244 of a conventional four reel slot machine. The information conveyed to the player in the poker display 242, in addition to his poker hand, can also include the hand of the winning player or in some circumstances it might be desirable to show the poker hands of all six players.

It should be understood that the system shown in FIG. 11 is just a representative example of a gaming system that can make use of the methods described below. For instance, two separate video displays can be substituted for the single display 240 or the first display 242 can be multiplexed with the second display 244 on the same video display. Also, an Internet arrangement can be used implement such a system where personal computers can serve as the player operated machines 224-232 and the lines 212-222 represent Internet connections with a control system resident on a server that functions as the system computer 210.

A method of prize structure construction will first be described in terms of a spinning reel slot machine prize structure with a poker driven approximation that can be used in a system of the type shown in FIG. 11. In poker games, generally the best hand wins. In most cases, the best hand is determined by what class the hand falls into. The nine major classes are ranked in terms of high card, one pair, two pair, three of a kind, straight, flush, full house, four of a kind, and straight flush. Table 1 below shows a conventional high level ranking of poker hands with the number of possible hands in a fifty two card deck. It is possible to use the probabilities of poker hands falling into these nine classes as a basis for approximating a payoff table of a spinning reel slot machine. However, because of the limited number of distinguished outcomes, only a very crude approximations to very limited payoff tables is possible. Such a crude design lacks what may be termed "granularity."

TABLE 1

High Level Ranking of Poker Hands

| Rank | Major Class | Number Of Hands |
|---|---|---|
| 9 | Straight Flush | 40 |
| 8 | Four of a Kind | 624 |
| 7 | Full House | 3744 |
| 6 | Flush | 5108 |
| 5 | Straight | 10200 |
| 4 | Three of a Kind | 54912 |
| 3 | Two Pair | 123552 |
| 2 | One Pair | 1098240 |
| 1 | High Card | 1302540 |
| | Total | 2598960 |

In this class structure, the hands are ranked by number or denomination with the ace as the highest, then the king, queen, Jack, and then ten down to the lowest which is the two. In other words if two players have one pair and one has a pair of 10's and the other a pair of nines, the tens are the superior hand. A straight is when the five cards in a hand have five numerical rankings that are in exact sequence. A flush means all five cards are of the same suit.

An additional refinement of the major classes of Table 1 is made possible by using the denomination to distinguish between hands of the same major class. For example with this refinement the major class Straight Flush is refined as shown in Table 2 below. Here, the single rank associated with the subgroup of Straight Flush Hands is refined or expanded into ten ranks. Thus the granularity of the outcomes is increased by a factor of ten.

TABLE 2

Ranking of Refined Straight Flush Subgroup of Poker hands

| Rank Within Subgroup | Hand Name | Number Of Hands |
|---|---|---|
| 10 | Ace High SF | 4 |
| 9 | King High SF | 4 |
| 8 | Queen High SF | 4 |
| 7 | Jack High SF | 4 |
| 6 | Ten High SF | 4 |
| 5 | 9 High SF | 4 |
| 4 | 8 High SF | 4 |
| 3 | 7 High SF | 4 |
| 2 | 6 High SF | 4 |
| 1 | 5 High SF | 4 |
| | Total | 40 |

Following this example, there are 7462 equivalence classes of poker hands in a fifty two card deck. An equivalence class is defined as all hands in that class are of equal value. In other words, two hands in the same equivalence class tie when resolving the payoff in a typical poker game. For example, the hands: Jh, Ts, 6d, 5d, 5s and Js, Td, 6d, 5c, 5h (where h represents hearts, s represents spades, d represents diamonds and c represents clubs) are in the same equivalence class that would normally be described as a pair of 5s with Jack, Ten and Six. Note that the hands: Jh, Ts, 6d, 5d, 5s and Js, Td, 7d, 5c, 5h are not in the same equivalence class although both hands are often described with the short hand notation "pair of 5s". The latter hand will win in a showdown and therefore is in its own class.

FIG. 12 is a table, in this case Table 3, that illustrates how granularity to the ranking of poker hands can be further increased by imposing a further ordering of some hands according to the suit of the high card in the straight. In this example, the suits are ranked in order: Spades, Hearts, Clubs, Diamonds. Again in this example, a Spade King High Straight flush is ranked higher than a Heart King High Straight Flush. Table 3 reflects this refinement as applied to the straight flush and the straight major hand classes. With these refinements there are a total of 7522 equivalence classes summarized in Table 3.

Thus, as demonstrated in the Table 3 of FIG. 12, the ranks of poker hands can be expanded from the basic nine major classes of Table 1 to the 7,522 classes of Table 3. As a result, and due to the resulting fine granularity of the 7522 equivalence classes, the prize structure of most spinning reel slot machines can be approximated well enough so that the poker driven version of the machine is indistinguishable from the original for the vast majority of players.

The following is a representative example of how the increased granularity of a prize structure of Table 3 in FIG. 12 can be implemented in the gaming system of FIG. 1.

In this example which has six players playing the machines 224-234 are each in effect dealt five cards by the system computer 210. Here, the five cards for the player on the machine 224 are dealt from a 52 card deck A, five cards for the player on the machine 26 are dealt from another 52 card deck B, etc. The cards as dealt can be displayed on the display 242. In this example, at each play of the game a prize is awarded to the player with the hand ranked highest. The value of the prize will be determined by the rank of the winning hand.

Table 4 below depicts an example of a prize structure for a spinning reel game with 13 prize levels, a win frequency of 1 in 6 and a return percentage to the proprietor of the system of 96.77%.

TABLE 4

Prize Structure of a Spinning Reel Game

| PRIZE LEVEL | PRIZE VALUE | Probability Of Prize Parts Per Million | Coins Out Per Million Coins In |
|---|---|---|---|
| 13 | 2000 | 3.81 | 7,629 |
| 12 | 800 | 22.89 | 18,311 |
| 11 | 400 | 99.18 | 39,673 |
| 10 | 200 | 305.18 | 61,035 |
| 9 | 160 | 64.85 | 10,376 |
| 8 | 100 | 419.62 | 41,962 |
| 7 | 80 | 446.32 | 35,706 |
| 6 | 40 | 2,876.28 | 115,051 |
| 5 | 20 | 9,391.78 | 187,836 |
| 4 | 10 | 7,057.19 | 70,572 |
| 3 | 5 | 25,215.15 | 126,076 |
| 2 | 4 | 5,985.26 | 23,941 |
| 1 | 2 | 114,780.43 | 229,561 |
| | Totals | 166,668 | 967,728 |

It is then possible to approximate the prize structure of the spinning reel game of Table 4 with a poker game by identifying every possible winning hand in the poker game with exactly one prize which is then awarded to the player holding that winning hand. Specifically, this approximation can be accomplished utilizing the enhanced granularity structure of Table 3. As a representative example, Table 5 below illustrates an approximation made with the winning hand outcomes of a 6 player stud poker game.

TABLE 5

Prize Structure of Poker Driven Game

| PRIZE LEVEL | PRIZE VALUE | Lowest Hand Rank | Highest Hand Rank | Probability Of Prize Parts Per Million | Coins Out Per Million Coins In |
|---|---|---|---|---|---|
| 13 | 2000 | 7,514 | 7522 | 20.78 | 6,926 |
| 12 | 800 | 7,476 | 7513 | 136.20 | 18,160 |
| 11 | 400 | 7,412 | 7475 | 590.78 | 39,386 |
| 10 | 200 | 7,308 | 7411 | 1835.11 | 61,170 |
| 9 | 160 | 7,301 | 7307 | 386.95 | 10,319 |
| 8 | 100 | 7,256 | 7300 | 2484.55 | 41,409 |
| 7 | 80 | 7,207 | 7255 | 2699.53 | 35,994 |
| 6 | 40 | 5,888 | 7206 | 17077.65 | 113,851 |
| 5 | 20 | 5,589 | 5887 | 56507.72 | 188,359 |
| 4 | 10 | 5,275 | 5588 | 42373.07 | 70,622 |
| 3 | 5 | 4,571 | 5274 | 151237.26 | 126,031 |
| 2 | 4 | 4,427 | 4570 | 35841.27 | 23,894 |
| 1 | 2 | 1 | 4426 | 688809.15 | 229,603 |
| | Totals | | | 1,000,000 | 965,723 |

In this example, the columns in Table 5 headed Lowest Hand Rank and Highest Hand Rank define the poker hands that yield the prize level. For example for prize level 2, the hand with rank 4427 is Two Pairs 9 9 7 7 6, the hand with rank 4570 is Two Pairs J J 5 5 7. A winning hand better than or equal to Two Pairs 9 9 7 7 6 and less than or equal to Two Pairs J J 5 5 7 will be awarded prize level 2. This will occur with probability 35,911.56 per million plays.

Another method for facilitating the operation of a gaming system of the type shown in FIG. 11 using a prize structure of the type described above is to construct a poker hand table with 2,598,960 records, one record for each possible poker hand. An example of a record structure in such a table is provided in Table 6 below. Preferably Table 6 is maintained in the system computer 210. In this embodiment, there will be one record in the Poker Hands Table 6 for each possible poker hand. The random selection of an integer in the range 1 to 2,598,960 can be used identify a specific poker hand in the Poker Hands Table 6. Here, selecting a random integer is equivalent to randomly dealing a poker hand.

TABLE 6

Record Structure of Poker Hands

| Field Name | Range | Memory Bytes |
|---|---|---|
| Rank | 1 to 7522 | 2 |
| Card 1 Index | 1 to 52 | 1 |
| Card 2 Index | 1 to 52 | 1 |
| Card 3 Index | 1 to 52 | 1 |
| Card 4 Index | 1 to 52 | 1 |
| Card 5 Index | 1 to 52 | 1 |

In this example, the Rank Description can contain a text description of the various hands such as "Full House of Aces Over Jacks." The Card Index portion of the table can also be used to access a graphic representation of each of the cards in the deck for display on the card portion 242 of the display 240 of the machines 224-234. For example, a graphic of the Queen of Hearts can be accessed with the Card index fields of the Table 6 for display on the video display 242 as one of the cards dealt to a player on that machine. It should be noted that everything necessary to display the spinning reel game results on the display 244 is well known to those skilled in the art of gaming machine design.

The following is an example of how a game can be executed on a system of the type shown in FIG. 11 utilizing the prize structure of Table 3 as shown in FIG. 12 and tables described above. In this example, the game is played with six players on the machines 224-234. In this example, the game logic is implemented at the system computer 210 with the players communicating with the game control or system computer 210 via the lines 212-222. First, a set of 6 random integers in the range 1 to 2,598,960 is selected by the computer 210. These integers can serve as the indices of the hands of the 6 players in the game. Preferably, in this version of the game, each of these integers is determined by an independent random selection from the range of 1 to 2,598,960, that is, in effect a hand each player is dealt from his own deck In this case, it is theoretically possible that duplicate hands can occur. In an alternative version, all players can be dealt from a common deck. Next, the hand indices are used to retrieve the respective records from the Poker Hands table, Table 6. Also, the Card 1 index, Card 2 index, Card 3 index, Card 4 index, Card 5 index fields of the retrieved records of Table 6 are used to determine the symbols to be displayed on the display 242 for each hand. Then, the system computer 210 determines the winner of the hand which would be the player whose retrieved record had maximum rank. At this point, the prize level to be awarded the winning player is determined by using the rank of his hand using Table 5. After the determination of the prize level for the winning player, a display of a spinning reel sequence can be generated on the display 244 for each of the machines 224-234 where the spinning reel sequence corresponds to the prize awarded to that player. Also, at this point the symbols for the poker hands drawn for each of the players can be shown in the displays 242. In this embodiment the prize amount for the winner can then be dispensed to the winning player via the slot 238. In this particular embodiment, there will be no prize for each of the non winning players.

The approach as described above has a number of significant advantages including the design of gaming systems where the prize structure of one game can be modified and utilized in connection with a payout format of another game such that the payouts can be designed so as to increase the attractiveness to players, provide a desired return to the game system's proprietor and conform to any statutory requirements. It will be appreciated that there are a wide variety of games, hardware and software in which these concepts can be implemented. For example, the embodiment of a gaming system described herein in is a multiplayer game, but the concept of enhancing the granularity of a prize structure of one game to provide a close simulation to the output of another game can be implemented in a single player or standalone video gaming machine. In addition to various types of poker, this approach of increasing the granularity of a first type game to approximate the display output of a second type of game such as a spinning real type slot machine can be used with other types of card games. For example, in a Black Jack game that uses multiple decks, the decks can be identified with different colors in order to expand the number of ranks. Other card games having player appeal which have hands that can be dealt on video gaming machines for which an expanded rank structure can be constructed: include Rummy, Hearts, Canasta, and Bridge.

Another advantage of constructing the prize or ranking structure as described above is that individual ranks of various hands can be adjusted on the basis of hand count per rank and number of hands per rank so as to enhance player enjoyment.

FIG. 13 is a table illustrating another method of increasing the granularity of a prize structure that can be used with the system of the type shown in FIG. 1. Here, the prize amounts are determined by scores of more than one hand. In the example described below, the prize structure of FIG. 13 can be used with a showdown poker game having players enrolled on six of the terminals 26-34 and where each of the players has his own deck.

As background, consider a conventional slot machine with a prize structure that awards a 1,000,000 coin prize for a single coin with, on average, 5% of the coins-in to be returned to the player via awards of this prize. In order to accomplish this objective, the determining event for this prize should occur on average once per 20,000,000 coins-in. One method for accomplishing this is by defining this rare event in the context of a 6 player stud poker game as follows. For example, in a 6 player game, 3,333,333 games produce 20,000,000 coins in. In this case, the prize is awarded when the winning player has a royal flush and the second best hand is better than a 7 high straight. The probability of the winning hand among 6 players being a royal flush is 9.234427 parts per million (ppm) as shown in column 3 of FIG. 3. The probability of the best hand in 5 non-winning hands being better than a 7 high straight is 0.031635 as shown in column 4. Then the probability of the joint event in which the winning hand is a royal flush and the next best hand is better than a 7 high straight is then 0.031635×9.234427 ppm=0.292136 ppm as shown in column 5. As a result, this event will occur once in 3,423,067 games played or one occurrence in 20,538,402.3 coins-in. The result is within about 2.7% of a design goal of 1 occurrence per 20,000,000 coins-in. This is usually an acceptable approximation to the goal. Also, as indicated in column 8 of FIG. 3, this particular pay scheme will return 94.86 percent of the coin-in to the players. In those cases where a closer approximation to the design goal is desired and the complexity of the defining event can be justified, the rank of the third best player's hand can be included to define a compound event incorporating the ranks of all three hands, that is, the winner's hand and that of the two next best hands. Moreover, this approach can be further extended to the hands of the remaining players. It should be noted that these calculations assume that each player is dealt from his own deck.

As with the other approaches as described above, the method of designing a prize structure illustrated in FIG. 13 has a number of significant advantages including the design of gaming systems where the prize structure of one game can be modified and utilized in connection with a payout format of another game such that the payouts can be designed so as to increase the attractiveness to players, provide a desired return to the game system's proprietor and conform to any statutory requirements. In addition, this process makes it possible to provide very high payouts as illustrated in the sixth column of FIG. 13.

We claim:

1. A bingo apparatus comprising:

a central controller having a digital computer;

a digital memory operatively connected to said central controller;

a plurality of game terminals operatively connected to said central controller wherein each of said each of said terminals includes a display and a set of player controls;

a working deck table located in said digital memory containing a record in vector form for each card in a set of bingo cards having a set of play symbols wherein each said record includes a card identifier and an identifier representing the locations on the card of said play symbols corresponding to a drawn ball;

a bit map cards table located in said digital memory containing a record for each said card wherein an identifier identifies the location of said play symbols on said card;

a winners table located in said digital memory containing representations of a set of winning patterns;

an update mechanism operatively associated with said central controller effective to update said records in said working deck table in response to a newly drawn ball wherein, for each card in said set, a bitwise operation is performed for each of said cards such that a record from said bit map cards table is used to update the corresponding record from said working deck table with the location of the symbol of said newly drawn ball if said symbol is on said card;

a bingo determination mechanism operatively associated with said central controller for comparing at least a portion of said records in said working deck table to said bingo winners bitmap to determine if any of said cards contain one of said winning patterns such that said comparison of said records in said working deck table to said bingo winners bitmap in combination with said bitwise operation permits the expeditious playing of a bingo game having many thousands of said cards; and a transmission mechanism operatively associated with said central controller for transmitting the outcome of said comparison to one or more of said game terminals.

2. The apparatus of claim 1 wherein said identifier in said working deck table is a single integer and said identifier in said bit maps cards table is a digital integer.

3. The apparatus of claim 2 wherein said update mechanism performs said bitwise operation for all said records in said working deck table in a single mechanical access to said bit map table.

4. The apparatus of claim 3 wherein said bitwise operation is performed in said digital computer using a SQL statement.

5. The apparatus of claim 4 wherein said bitwise operation is effective to update said single integer representing the location on the card of said play symbols for said cards having the play symbol corresponding to said play symbol on said newly drawn ball.

6. The apparatus of claim 2 wherein said representations in said bingo winners table are a plurality of single integer bit vectors each representing one of said winning pattern.

* * * * *